US007710353B2

(12) United States Patent
Sato et al.

(10) Patent No.: US 7,710,353 B2
(45) Date of Patent: May 4, 2010

(54) DRIVING METHOD OF A DISPLAY PANEL

(75) Inventors: Yoshichika Sato, Chuo (JP); Kazuaki Sakata, Chuo (JP); Shigeru Iwaoka, Chuo (JP); Kenichiro Hosoi, Chuo (JP); Takeharu Iwata, Chuo (JP)

(73) Assignee: Panasonic Corporation, Osaka (JP)

( * ) Notice: Subject to any disclaimer, the term of this patent is extended or adjusted under 35 U.S.C. 154(b) by 1103 days.

(21) Appl. No.: 11/362,263

(22) Filed: Feb. 27, 2006

(65) Prior Publication Data

US 2006/0227072 A1 Oct. 12, 2006

(30) Foreign Application Priority Data

Mar. 2, 2005 (JP) ..... 2005-057297

(51) Int. Cl.
*G09G 3/28* (2006.01)

(52) U.S. Cl. ..... 345/60; 315/169.4

(58) Field of Classification Search ..... 345/60–72; 315/169.4

See application file for complete search history.

(56) References Cited

U.S. PATENT DOCUMENTS 6,392,616 B1 * 5/2002 Suzuki et al. ..... 345/60
6,476,781 B1 * 11/2002 Suzuki et al. ..... 345/60
6,483,248 B2 * 11/2002 Nagakubo et al. ..... 315/169.3
6,495,968 B2 * 12/2002 Tokunaga ..... 315/169.4
6,518,943 B1 * 2/2003 Masumura ..... 345/67
6,614,413 B2 * 9/2003 Tokunaga et al. ..... 345/63
6,630,796 B2 * 10/2003 Tokunaga et al. ..... 315/169.4
7,075,243 B2 * 7/2006 Park ..... 315/169.4
2003/0006944 A1 * 1/2003 Iwami et al. ..... 345/60
2003/0011540 A1 * 1/2003 Tokunaga et al. ..... 345/60

FOREIGN PATENT DOCUMENTS

JP 2003-22045 1/2003

* cited by examiner

*Primary Examiner*—Sumati Lefkowitz
*Assistant Examiner*—Seokyun Moon
(74) *Attorney, Agent, or Firm*—Drinker Biddle & Reath LLP

(57) ABSTRACT

A method of driving a display panel is provided which can reduce power consumption. During a unit display period, the number of times of second and subsequent selective erase operations performed on one display cell of each pixel is different from the number of times of second and subsequent selective erase operations performed on another display cell emitting light of different color from that of the one display cell.

4 Claims, 15 Drawing Sheets

[ FOR DRIVING RED / GREEN CELL ]

| DATA CONVERTION TABLE B | | | | | | | | | | | | | | | SF LIGHT EMISSION DRIVE PATTERN | | | | | | | | | | | | | | LUMINANCE RATIO |
|---|---|---|---|---|---|---|---|---|---|---|---|---|---|---|---|---|---|---|---|---|---|---|---|---|---|---|---|---|---|
| PDs | GD 1 | 2 | 3 | 4 | 5 | 6 | 7 | 8 | 9 | 10 | 11 | 12 | 13 | 14 | SF1 | SF2 | SF3 | SF4 | SF5 | SF6 | SF7 | SF8 | SF9 | SF10 | SF11 | SF12 | SF13 | SF14 | |
| 0000 | 1 | 1 | 1 | 0 | 0 | 0 | 0 | 0 | 0 | 0 | 0 | 0 | 0 | 0 | ● | ▲ | ▲ | | | | | | | | | | | | 0 |
| 0001 | 0 | 1 | 1 | 1 | 0 | 0 | 0 | 0 | 0 | 0 | 0 | 0 | 0 | 0 | ○ | ● | ▲ | ▲ | | | | | | | | | | | 1 |
| 0010 | 0 | 0 | 1 | 1 | 1 | 0 | 0 | 0 | 0 | 0 | 0 | 0 | 0 | 0 | ○ | ○ | ● | ▲ | ▲ | | | | | | | | | | 4 |
| 0011 | 0 | 0 | 0 | 1 | 1 | 1 | 0 | 0 | 0 | 0 | 0 | 0 | 0 | 0 | ○ | ○ | ○ | ● | ▲ | ▲ | | | | | | | | | 9 |
| 0100 | 0 | 0 | 0 | 0 | 1 | 1 | 1 | 0 | 0 | 0 | 0 | 0 | 0 | 0 | ○ | ○ | ○ | ○ | ● | ▲ | ▲ | | | | | | | | 17 |
| 0101 | 0 | 0 | 0 | 0 | 0 | 1 | 1 | 1 | 0 | 0 | 0 | 0 | 0 | 0 | ○ | ○ | ○ | ○ | ○ | ● | ▲ | ▲ | | | | | | | 27 |
| 0110 | 0 | 0 | 0 | 0 | 0 | 0 | 1 | 1 | 1 | 0 | 0 | 0 | 0 | 0 | ○ | ○ | ○ | ○ | ○ | ○ | ● | ▲ | ▲ | | | | | | 40 |
| 0111 | 0 | 0 | 0 | 0 | 0 | 0 | 0 | 1 | 1 | 1 | 0 | 0 | 0 | 0 | ○ | ○ | ○ | ○ | ○ | ○ | ○ | ● | ▲ | ▲ | | | | | 56 |
| 1000 | 0 | 0 | 0 | 0 | 0 | 0 | 0 | 0 | 1 | 1 | 1 | 0 | 0 | 0 | ○ | ○ | ○ | ○ | ○ | ○ | ○ | ○ | ● | ▲ | ▲ | | | | 75 |
| 1001 | 0 | 0 | 0 | 0 | 0 | 0 | 0 | 0 | 0 | 1 | 1 | 1 | 0 | 0 | ○ | ○ | ○ | ○ | ○ | ○ | ○ | ○ | ○ | ● | ▲ | ▲ | | | 97 |
| 1010 | 0 | 0 | 0 | 0 | 0 | 0 | 0 | 0 | 0 | 0 | 1 | 1 | 1 | 0 | ○ | ○ | ○ | ○ | ○ | ○ | ○ | ○ | ○ | ○ | ● | ▲ | ▲ | | 122 |
| 1011 | 0 | 0 | 0 | 0 | 0 | 0 | 0 | 0 | 0 | 0 | 0 | 1 | 1 | 1 | ○ | ○ | ○ | ○ | ○ | ○ | ○ | ○ | ○ | ○ | ○ | ● | ▲ | ▲ | 150 |
| 1100 | 0 | 0 | 0 | 0 | 0 | 0 | 0 | 0 | 0 | 0 | 0 | 0 | 1 | 1 | ○ | ○ | ○ | ○ | ○ | ○ | ○ | ○ | ○ | ○ | ○ | ○ | ● | ▲ | 182 |
| 1101 | 0 | 0 | 0 | 0 | 0 | 0 | 0 | 0 | 0 | 0 | 0 | 0 | 0 | 1 | ○ | ○ | ○ | ○ | ○ | ○ | ○ | ○ | ○ | ○ | ○ | ○ | ○ | ● | 217 |
| 1110 | 0 | 0 | 0 | 0 | 0 | 0 | 0 | 0 | 0 | 0 | 0 | 0 | 0 | 0 | ○ | ○ | ○ | ○ | ○ | ○ | ○ | ○ | ○ | ○ | ○ | ○ | ○ | ○ | 255 |

● ▲ : SELECTIVE ERASE DISCHARGE
○ : SUSTAIN DISCHARGE LIGHT EMISSION

FIG. 4

[FOR DRIVING BLUE CELL]

| DATA CONVERTION TABLE A | | | | | | | | | | | | | | | SF LIGHT EMISSION DRIVE PATTERN | | | | | | | | | | | | | | LUMINANCE RATIO |
|---|---|---|---|---|---|---|---|---|---|---|---|---|---|---|---|---|---|---|---|---|---|---|---|---|---|---|---|---|---|
| PDs | GD 1 | 2 | 3 | 4 | 5 | 6 | 7 | 8 | 9 | 10 | 11 | 12 | 13 | 14 | SF1 | SF2 | SF3 | SF4 | SF5 | SF6 | SF7 | SF8 | SF9 | SF10 | SF11 | SF12 | SF13 | SF14 | |
| 0000 | 1 | 1 | 1 | 1 | 1 | 1 | 1 | 1 | 1 | 1 | 1 | 1 | 1 | 1 | ● | ▲ | ▲ | ▲ | ▲ | ▲ | ▲ | ▲ | ▲ | ▲ | ▲ | ▲ | ▲ | ▲ | 0 |
| 0001 | 0 | 1 | 1 | 1 | 1 | 1 | 1 | 1 | 1 | 1 | 1 | 1 | 1 | 1 | ○ | ● | ▲ | ▲ | ▲ | ▲ | ▲ | ▲ | ▲ | ▲ | ▲ | ▲ | ▲ | ▲ | 1 |
| 0010 | 0 | 0 | 1 | 1 | 1 | 1 | 1 | 1 | 1 | 1 | 1 | 1 | 1 | 1 | ○ | ○ | ● | ▲ | ▲ | ▲ | ▲ | ▲ | ▲ | ▲ | ▲ | ▲ | ▲ | ▲ | 4 |
| 0011 | 0 | 0 | 0 | 1 | 1 | 1 | 1 | 1 | 1 | 1 | 1 | 1 | 1 | 1 | ○ | ○ | ○ | ● | ▲ | ▲ | ▲ | ▲ | ▲ | ▲ | ▲ | ▲ | ▲ | ▲ | 9 |
| 0100 | 0 | 0 | 0 | 0 | 1 | 1 | 1 | 1 | 1 | 1 | 1 | 1 | 1 | 1 | ○ | ○ | ○ | ○ | ● | ▲ | ▲ | ▲ | ▲ | ▲ | ▲ | ▲ | ▲ | ▲ | 17 |
| 0101 | 0 | 0 | 0 | 0 | 0 | 1 | 1 | 1 | 1 | 1 | 1 | 1 | 1 | 1 | ○ | ○ | ○ | ○ | ○ | ● | ▲ | ▲ | ▲ | ▲ | ▲ | ▲ | ▲ | ▲ | 27 |
| 0110 | 0 | 0 | 0 | 0 | 0 | 0 | 1 | 1 | 1 | 1 | 1 | 1 | 1 | 1 | ○ | ○ | ○ | ○ | ○ | ○ | ● | ▲ | ▲ | ▲ | ▲ | ▲ | ▲ | ▲ | 40 |
| 0111 | 0 | 0 | 0 | 0 | 0 | 0 | 0 | 1 | 1 | 1 | 1 | 1 | 1 | 1 | ○ | ○ | ○ | ○ | ○ | ○ | ○ | ● | ▲ | ▲ | ▲ | ▲ | ▲ | ▲ | 56 |
| 1000 | 0 | 0 | 0 | 0 | 0 | 0 | 0 | 0 | 1 | 1 | 1 | 1 | 1 | 1 | ○ | ○ | ○ | ○ | ○ | ○ | ○ | ○ | ● | ▲ | ▲ | ▲ | ▲ | ▲ | 75 |
| 1001 | 0 | 0 | 0 | 0 | 0 | 0 | 0 | 0 | 0 | 1 | 1 | 1 | 1 | 1 | ○ | ○ | ○ | ○ | ○ | ○ | ○ | ○ | ○ | ● | ▲ | ▲ | ▲ | ▲ | 97 |
| 1010 | 0 | 0 | 0 | 0 | 0 | 0 | 0 | 0 | 0 | 0 | 1 | 1 | 1 | 1 | ○ | ○ | ○ | ○ | ○ | ○ | ○ | ○ | ○ | ○ | ● | ▲ | ▲ | ▲ | 122 |
| 1011 | 0 | 0 | 0 | 0 | 0 | 0 | 0 | 0 | 0 | 0 | 0 | 1 | 1 | 1 | ○ | ○ | ○ | ○ | ○ | ○ | ○ | ○ | ○ | ○ | ○ | ● | ▲ | ▲ | 150 |
| 1100 | 0 | 0 | 0 | 0 | 0 | 0 | 0 | 0 | 0 | 0 | 0 | 0 | 1 | 1 | ○ | ○ | ○ | ○ | ○ | ○ | ○ | ○ | ○ | ○ | ○ | ○ | ● | ▲ | 182 |
| 1101 | 0 | 0 | 0 | 0 | 0 | 0 | 0 | 0 | 0 | 0 | 0 | 0 | 0 | 1 | ○ | ○ | ○ | ○ | ○ | ○ | ○ | ○ | ○ | ○ | ○ | ○ | ○ | ● | 217 |
| 1110 | 0 | 0 | 0 | 0 | 0 | 0 | 0 | 0 | 0 | 0 | 0 | 0 | 0 | 0 | ○ | ○ | ○ | ○ | ○ | ○ | ○ | ○ | ○ | ○ | ○ | ○ | ○ | ○ | 255 |

● ▲ : SELECTIVE ERASE DISCHARGE

○ : SUSTAIN DISCHARGE LIGHT EMISSION

FIG. 5

[ FOR DRIVING RED / GREEN CELL ]

| DATA CONVERTION TABLE B | | | | | | | | | | | | | | | SF LIGHT EMISSION DRIVE PATTERN | | | | | | | | | | | | | | LUMINANCE RATIO |
|---|---|---|---|---|---|---|---|---|---|---|---|---|---|---|---|---|---|---|---|---|---|---|---|---|---|---|---|---|---|
| PDs | GD 1 | 2 | 3 | 4 | 5 | 6 | 7 | 8 | 9 | 10 | 11 | 12 | 13 | 14 | SF1 | SF2 | SF3 | SF4 | SF5 | SF6 | SF7 | SF8 | SF9 | SF10 | SF11 | SF12 | SF13 | SF14 | |
| 0000 | 1 | 1 | 1 | 0 | 0 | 0 | 0 | 0 | 0 | 0 | 0 | 0 | 0 | 0 | ● | ▲ | ▲ | | | | | | | | | | | | 0 |
| 0001 | 0 | 1 | 1 | 1 | 0 | 0 | 0 | 0 | 0 | 0 | 0 | 0 | 0 | 0 | ○ | ● | ▲ | ▲ | | | | | | | | | | | 1 |
| 0010 | 0 | 0 | 1 | 1 | 1 | 0 | 0 | 0 | 0 | 0 | 0 | 0 | 0 | 0 | ○ | ○ | ● | ▲ | ▲ | | | | | | | | | | 4 |
| 0011 | 0 | 0 | 0 | 1 | 1 | 1 | 0 | 0 | 0 | 0 | 0 | 0 | 0 | 0 | ○ | ○ | ○ | ● | ▲ | ▲ | | | | | | | | | 9 |
| 0100 | 0 | 0 | 0 | 0 | 1 | 1 | 1 | 0 | 0 | 0 | 0 | 0 | 0 | 0 | ○ | ○ | ○ | ○ | ● | ▲ | ▲ | | | | | | | | 17 |
| 0101 | 0 | 0 | 0 | 0 | 0 | 1 | 1 | 1 | 0 | 0 | 0 | 0 | 0 | 0 | ○ | ○ | ○ | ○ | ○ | ● | ▲ | ▲ | | | | | | | 27 |
| 0110 | 0 | 0 | 0 | 0 | 0 | 0 | 1 | 1 | 1 | 0 | 0 | 0 | 0 | 0 | ○ | ○ | ○ | ○ | ○ | ○ | ● | ▲ | ▲ | | | | | | 40 |
| 0111 | 0 | 0 | 0 | 0 | 0 | 0 | 0 | 1 | 1 | 1 | 0 | 0 | 0 | 0 | ○ | ○ | ○ | ○ | ○ | ○ | ○ | ● | ▲ | ▲ | | | | | 56 |
| 1000 | 0 | 0 | 0 | 0 | 0 | 0 | 0 | 0 | 1 | 1 | 1 | 0 | 0 | 0 | ○ | ○ | ○ | ○ | ○ | ○ | ○ | ○ | ● | ▲ | ▲ | | | | 75 |
| 1001 | 0 | 0 | 0 | 0 | 0 | 0 | 0 | 0 | 0 | 1 | 1 | 1 | 0 | 0 | ○ | ○ | ○ | ○ | ○ | ○ | ○ | ○ | ○ | ● | ▲ | ▲ | | | 97 |
| 1010 | 0 | 0 | 0 | 0 | 0 | 0 | 0 | 0 | 0 | 0 | 1 | 1 | 1 | 0 | ○ | ○ | ○ | ○ | ○ | ○ | ○ | ○ | ○ | ○ | ◐ | ▲ | ▲ | | 122 |
| 1011 | 0 | 0 | 0 | 0 | 0 | 0 | 0 | 0 | 0 | 0 | 0 | 1 | 1 | 1 | ○ | ○ | ○ | ○ | ○ | ○ | ○ | ○ | ○ | ○ | ○ | ● | ▲ | ▲ | 150 |
| 1100 | 0 | 0 | 0 | 0 | 0 | 0 | 0 | 0 | 0 | 0 | 0 | 0 | 1 | 1 | ○ | ○ | ○ | ○ | ○ | ○ | ○ | ○ | ○ | ○ | ○ | ○ | ● | ▲ | 182 |
| 1101 | 0 | 0 | 0 | 0 | 0 | 0 | 0 | 0 | 0 | 0 | 0 | 0 | 0 | 1 | ○ | ○ | ○ | ○ | ○ | ○ | ○ | ○ | ○ | ○ | ○ | ○ | ○ | ● | 217 |
| 1110 | 0 | 0 | 0 | 0 | 0 | 0 | 0 | 0 | 0 | 0 | 0 | 0 | 0 | 0 | ○ | ○ | ○ | ○ | ○ | ○ | ○ | ○ | ○ | ○ | ○ | ○ | ○ | ○ | 255 |

● ▲ : SELECTIVE ERASE DISCHARGE

○ : SUSTAIN DISCHARGE LIGHT EMISSION

FIG. 8

| DISPLAY CELL | PDs | GD 1 | 2 | 3 | 4 | 5 | 6 | 7 | 8 | 9 | 10 | 11 | 12 | 13 | 14 | SF1 | SF2 | SF3 | SF4 | SF5 | SF6 | SF7 | SF8 | SF9 | SF10 | SF11 | SF12 | SF13 | SF14 | LUMINANCE RATIO |
|---|---|---|---|---|---|---|---|---|---|---|---|---|---|---|---|---|---|---|---|---|---|---|---|---|---|---|---|---|---|---|
| $C_{R1}$ | 0010 | 0 | 0 | 1 | 1 | 1 | 0 | 0 | 0 | 0 | 0 | 0 | 0 | 0 | 0 | ○ | ○ | ● | ▲ | ▲ | | | | | | | | | | 4 |
| $C_{G1}$ | 0110 | 0 | 0 | 0 | 0 | 0 | 0 | 1 | 1 | 1 | 0 | 0 | 0 | 0 | 0 | ○ | ○ | ○ | ○ | ○ | ○ | ● | ▲ | ▲ | | | | | | 40 |
| $C_{B1}$ | 0011 | 0 | 0 | 0 | 1 | 1 | 1 | 0 | 0 | 0 | 0 | 0 | 0 | 0 | 0 | ○ | ○ | ○ | ● | ▲ | ▲ | ▲ | ▲ | ▲ | ▲ | ▲ | ▲ | ▲ | ▲ | 9 |
| $C_{R2}$ | 0101 | 0 | 0 | 0 | 0 | 0 | 1 | 1 | 1 | 0 | 0 | 0 | 0 | 0 | 0 | ○ | ○ | ○ | ○ | ○ | ● | ▲ | ▲ | | | | | | | 27 |
| $C_{G2}$ | 0011 | 0 | 0 | 0 | 1 | 1 | 1 | 0 | 0 | 0 | 0 | 0 | 0 | 0 | 0 | ○ | ○ | ○ | ● | ▲ | ▲ | | | | | | | | | 9 |
| $C_{B2}$ | 0010 | 0 | 0 | 1 | 1 | 1 | 0 | 0 | 0 | 0 | 0 | 0 | 0 | 0 | 0 | ○ | ○ | ● | ▲ | ▲ | ▲ | ▲ | ▲ | ▲ | ▲ | ▲ | ▲ | ▲ | ▲ | 4 |

SF LIGHT EMISSION DRIVE PATTERN

● ▲ : SELECTIVE ERASE DISCHARGE

○ : SUSTAIN DISCHARGE LIGHT EMISSION

FIG. 10

| DISPLAY CELL | SF1 | SF2 | SF3 | SF4 | SF5 | SF6 | SF7 | SF8 | SF9 | SF10 | SF11 | SF12 | SF13 | SF14 | LUMINANCE RATIO |
|---|---|---|---|---|---|---|---|---|---|---|---|---|---|---|---|
| | SF LIGHT EMISSION DRIVE PATTERN | | | | | | | | | | | | | | |
| $C_{R1}$ | ○ | ○ | ● | | | | ▲ | | | | | | | | 4 |
| $C_{G1}$ | ○ | ○ | ○ | ○ | ○ | ○ | ● | | | | | | | | 40 |
| $C_{B1}$ | ○ | ○ | ○ | ● | | ▲ | ▲ | | | | | | | | 9 |
| $C_{R2}$ | ○ | ○ | ○ | ○ | ○ | ● | | | | | | | | | 27 |
| $C_{G2}$ | ○ | ○ | ○ | ● | | ▲ | | | | | | | | | 9 |
| $C_{B2}$ | ○ | ○ | ● | ▲ | | | | | | | | | | | 4 |

● ▲ : SELECTIVE ERASE DISCHARGE

○ : SUSTAIN DISCHARGE LIGHT EMISSION

FIG. 12

| DATA CONVERTION TABLE A | | | | | | | | | | | | | | | SF LIGHT EMISSION DRIVE PATTERN | | | | | | | | | | | | | | LUMINANCE RATIO |
|---|---|---|---|---|---|---|---|---|---|---|---|---|---|---|---|---|---|---|---|---|---|---|---|---|---|---|---|---|---|
| PDs | GD 1 | 2 | 3 | 4 | 5 | 6 | 7 | 8 | 9 | 10 | 11 | 12 | 13 | 14 | SF1 | SF2 | SF3 | SF4 | SF5 | SF6 | SF7 | SF8 | SF9 | SF10 | SF11 | SF12 | SF13 | SF14 | |
| 0000 | 1 | 0 | 0 | 0 | 0 | 0 | 0 | 0 | 0 | 1 | 0 | 0 | 0 | 0 | ● | | | | | | | | | ▲ | | | | | 0 |
| 0001 | 0 | 1 | 0 | 0 | 0 | 0 | 0 | 0 | 0 | 1 | 0 | 0 | 0 | 0 | ○ | ● | | | | | | | | ▲ | | | | | 1 |
| 0010 | 0 | 0 | 1 | 0 | 0 | 0 | 0 | 0 | 0 | 1 | 0 | 0 | 0 | 0 | ○ | ○ | ● | | | | | | | ▲ | | | | | 4 |
| 0011 | 0 | 0 | 0 | 1 | 0 | 0 | 0 | 0 | 0 | 1 | 0 | 0 | 0 | 0 | ○ | ○ | ○ | ● | | | | | | ▲ | | | | | 9 |
| 0100 | 0 | 0 | 0 | 0 | 1 | 0 | 0 | 0 | 0 | 1 | 0 | 0 | 0 | 0 | ○ | ○ | ○ | ○ | ● | | | | | ▲ | | | | | 17 |
| 0101 | 0 | 0 | 0 | 0 | 0 | 1 | 0 | 0 | 0 | 1 | 0 | 0 | 0 | 0 | ○ | ○ | ○ | ○ | ○ | ● | | | | ▲ | | | | | 27 |
| 0110 | 0 | 0 | 0 | 0 | 0 | 0 | 1 | 0 | 0 | 1 | 0 | 0 | 0 | 0 | ○ | ○ | ○ | ○ | ○ | ○ | ● | | | ▲ | | | | | 40 |
| 0111 | 0 | 0 | 0 | 0 | 0 | 0 | 0 | 1 | 0 | 1 | 0 | 0 | 0 | 0 | ○ | ○ | ○ | ○ | ○ | ○ | ○ | ● | | ▲ | | | | | 56 |
| 1000 | 0 | 0 | 0 | 0 | 0 | 0 | 0 | 0 | 1 | 0 | 1 | 0 | 0 | 0 | ○ | ○ | ○ | ○ | ○ | ○ | ○ | ○ | ● | | ▲ | | | | 75 |
| 1001 | 0 | 0 | 0 | 0 | 0 | 0 | 0 | 0 | 0 | 1 | 0 | 1 | 0 | 0 | ○ | ○ | ○ | ○ | ○ | ○ | ○ | ○ | ○ | ● | | ▲ | | | 97 |
| 1010 | 0 | 0 | 0 | 0 | 0 | 0 | 0 | 0 | 0 | 0 | 1 | 0 | 1 | 0 | ○ | ○ | ○ | ○ | ○ | ○ | ○ | ○ | ○ | ○ | ◐ | | ▲ | | 122 |
| 1011 | 0 | 0 | 0 | 0 | 0 | 0 | 0 | 0 | 0 | 0 | 0 | 1 | 0 | 1 | ○ | ○ | ○ | ○ | ○ | ○ | ○ | ○ | ○ | ○ | ○ | ● | | ▲ | 150 |
| 1100 | 0 | 0 | 0 | 0 | 0 | 0 | 0 | 0 | 0 | 0 | 0 | 0 | 1 | 1 | ○ | ○ | ○ | ○ | ○ | ○ | ○ | ○ | ○ | ○ | ○ | ○ | ● | ▲ | 182 |
| 1101 | 0 | 0 | 0 | 0 | 0 | 0 | 0 | 0 | 0 | 0 | 0 | 0 | 0 | 1 | ○ | ○ | ○ | ○ | ○ | ○ | ○ | ○ | ○ | ○ | ○ | ○ | ○ | ● | 217 |
| 1110 | 0 | 0 | 0 | 0 | 0 | 0 | 0 | 0 | 0 | 0 | 0 | 0 | 0 | 0 | ○ | ○ | ○ | ○ | ○ | ○ | ○ | ○ | ○ | ○ | ○ | ○ | ○ | ○ | 255 |

● ▲ : SELECTIVE ERASE DISCHARGE

○ : SUSTAIN DISCHARGE LIGHT EMISSION

FIG. 13

| DATA CONVERTION TABLE B | | | | | | | | | | | | | | | SF LIGHT EMISSION DRIVE PATTERN | | | | | | | | | | | | | | LUMINANCE RATIO |
|---|---|---|---|---|---|---|---|---|---|---|---|---|---|---|---|---|---|---|---|---|---|---|---|---|---|---|---|---|---|
| PDs | GD 1 | 2 | 3 | 4 | 5 | 6 | 7 | 8 | 9 | 10 | 11 | 12 | 13 | 14 | SF1 | SF2 | SF3 | SF4 | SF5 | SF6 | SF7 | SF8 | SF9 | SF10 | SF11 | SF12 | SF13 | SF14 | |
| 0000 | 1 | 0 | 0 | 0 | 0 | 0 | 0 | 0 | 1 | 0 | 0 | 0 | 0 | 0 | ● | | | | | | | | ▲ | | | | | | 0 |
| 0001 | 0 | 1 | 0 | 0 | 0 | 0 | 0 | 0 | 1 | 0 | 0 | 0 | 0 | 0 | ○ | ● | | | | | | | ▲ | | | | | | 1 |
| 0010 | 0 | 0 | 1 | 0 | 0 | 0 | 0 | 0 | 1 | 0 | 0 | 0 | 0 | 0 | ○ | ○ | ● | | | | | | ▲ | | | | | | 4 |
| 0011 | 0 | 0 | 0 | 1 | 0 | 0 | 0 | 0 | 1 | 0 | 0 | 0 | 0 | 0 | ○ | ○ | ○ | ● | | | | | ▲ | | | | | | 9 |
| 0100 | 0 | 0 | 0 | 0 | 1 | 0 | 0 | 0 | 1 | 0 | 0 | 0 | 0 | 0 | ○ | ○ | ○ | ○ | ● | | | | ▲ | | | | | | 17 |
| 0101 | 0 | 0 | 0 | 0 | 0 | 1 | 0 | 0 | 1 | 0 | 0 | 0 | 0 | 0 | ○ | ○ | ○ | ○ | ○ | ● | | | ▲ | | | | | | 27 |
| 0110 | 0 | 0 | 0 | 0 | 0 | 0 | 1 | 0 | 1 | 0 | 0 | 0 | 0 | 0 | ○ | ○ | ○ | ○ | ○ | ○ | ● | | ▲ | | | | | | 40 |
| 0111 | 0 | 0 | 0 | 0 | 0 | 0 | 0 | 1 | 0 | 1 | 0 | 0 | 0 | 0 | ○ | ○ | ○ | ○ | ○ | ○ | ○ | ● | | ▲ | | | | | 56 |
| 1000 | 0 | 0 | 0 | 0 | 0 | 0 | 0 | 0 | 1 | 0 | 1 | 0 | 0 | 0 | ○ | ○ | ○ | ○ | ○ | ○ | ○ | ○ | ● | | ▲ | | | | 75 |
| 1001 | 0 | 0 | 0 | 0 | 0 | 0 | 0 | 0 | 0 | 1 | 0 | 1 | 0 | 0 | ○ | ○ | ○ | ○ | ○ | ○ | ○ | ○ | ○ | ● | | ▲ | | | 97 |
| 1010 | 0 | 0 | 0 | 0 | 0 | 0 | 0 | 0 | 0 | 0 | 1 | 0 | 1 | 0 | ○ | ○ | ○ | ○ | ○ | ○ | ○ | ○ | ○ | ○ | ● | | ▲ | | 122 |
| 1011 | 0 | 0 | 0 | 0 | 0 | 0 | 0 | 0 | 0 | 0 | 0 | 1 | 0 | 1 | ○ | ○ | ○ | ○ | ○ | ○ | ○ | ○ | ○ | ○ | ○ | ● | | ▲ | 150 |
| 1100 | 0 | 0 | 0 | 0 | 0 | 0 | 0 | 0 | 0 | 0 | 0 | 0 | 1 | 1 | ○ | ○ | ○ | ○ | ○ | ○ | ○ | ○ | ○ | ○ | ○ | ○ | ● | ▲ | 182 |
| 1101 | 0 | 0 | 0 | 0 | 0 | 0 | 0 | 0 | 0 | 0 | 0 | 0 | 0 | 1 | ○ | ○ | ○ | ○ | ○ | ○ | ○ | ○ | ○ | ○ | ○ | ○ | ○ | ● | 217 |
| 1110 | 0 | 0 | 0 | 0 | 0 | 0 | 0 | 0 | 0 | 0 | 0 | 0 | 0 | 0 | ○ | ○ | ○ | ○ | ○ | ○ | ○ | ○ | ○ | ○ | ○ | ○ | ○ | ○ | 255 |

● ▲ : SELECTIVE ERASE DISCHARGE

○ : SUSTAIN DISCHARGE LIGHT EMISSION

FIG. 14

| DISPLAY CELL | SF LIGHT EMISSION DRIVE PATTERN | | | | | | | | | | | | | |
|---|---|---|---|---|---|---|---|---|---|---|---|---|---|---|
| | SF1 | SF2 | SF3 | SF4 | SF5 | SF6 | SF7 | SF8 | SF9 | SF10 | SF11 | SF12 | SF13 | SF14 |
| $C_{R1}$ | ○ | ○ | ○ | ○ | ○ | ● | | | | ▲ | | | | |
| $C_{G1}$ | ○ | ○ | ○ | ○ | ○ | ○ | ○ | ○ | ○ | ● | | ▲ | | |
| $C_{B1}$ | ○ | ○ | ○ | ○ | ○ | ○ | ● | | | ▲ | | | | |
| $C_{R2}$ | ○ | ○ | ○ | ○ | ○ | ○ | ○ | ● | | ▲ | | | | |
| $C_{G2}$ | ○ | ○ | ○ | ○ | ○ | ○ | ● | | | ▲ | | | | |
| $C_{B2}$ | ○ | ○ | ○ | ○ | ○ | ● | | | | ▲ | | | | |

● ▲ : SELECTIVE ERASE DISCHARGE

○ : SUSTAIN DISCHARGE LIGHT EMISSION

FIG. 15

| DISPLAY CELL | SF LIGHT EMISSION DRIVE PATTERN | | | | | | | | | | | | | |
|---|---|---|---|---|---|---|---|---|---|---|---|---|---|---|
| | SF1 | SF2 | SF3 | SF4 | SF5 | SF6 | SF7 | SF8 | SF9 | SF10 | SF11 | SF12 | SF13 | SF14 |
| $C_{R1}$ | ○ | ○ | ○ | ○ | ● | | | | ▲ | | | | | |
| $C_{G1}$ | ○ | ○ | ○ | ○ | ○ | ○ | ○ | ○ | ● | | ▲ | | | |
| $C_{B1}$ | ○ | ○ | ○ | ○ | ○ | ● | | | ▲ | | | | | |
| $C_{R2}$ | ○ | ○ | ○ | ○ | ○ | ○ | ● | | ▲ | | | | | |
| $C_{G2}$ | ○ | ○ | ○ | ○ | ○ | ● | | | ▲ | | | | | |
| $C_{B2}$ | ○ | ○ | ○ | ○ | ● | | | | ▲ | | | | | |

● ▲ : SELECTIVE ERASE DISCHARGE

○ : SUSTAIN DISCHARGE LIGHT EMISSION

DRIVING METHOD OF A DISPLAY PANEL

BACKGROUND OF THE INVENTION

1. Field of the Invention

The present invention relates to a method of driving a matrix-display-type display panel.

2. Description of the Related Art

In recent years, plasma display devices having an AC (AC discharge) type plasma display panel (hereinafter, referred to as PDP), which is a small-sized display panel, mounted thereon, have been produced (see, for example, Japanese Patent Kokai No. 2003-22045 (hereinafter, referred to as Patent Document 1).

In a PDP, a display cell having a discharge space is formed at each of the intersections of a plurality of column electrodes and a plurality of row electrodes. The plurality of column electrodes are disposed to extend in a longitudinal direction (vertical direction) of a two-dimensional display screen, and the plurality of row electrodes are disposed to extend in a transverse direction (horizontal direction). A plasma display device selectively discharges display cells by applying various driving pulses to the column electrodes and the row electrodes of the PDP, and forms display images on a screen by light emission through the discharge. At this time, since each of the display cells emits light using a discharge phenomenon, it emits light with the highest luminance or does not emit light. That is, each of the display cells can express only two luminance levels corresponding two grayscales. Thus, grayscale drive based on a subfield method is performed to realize intermediate luminance display according to an input video signal in the PDP having the display cells.

In the grayscale drive based on a subfield method, a display period of an image corresponding to one field or one frame is divided into N subfields. A light emission period (the number of times of light emission) corresponding to the weight of each of bits of the pixel data (N bits) is allocated to each subfield, and the light emission drive for the PDP is performed.

For example, when one field is divided into six subfields SF1 to SF6, the following light emission periods are respectively allocated to the subfields (see FIG. 1 of Patent Document 1).

SF1: 1
SF2: 2
SF3: 4
SF4: 8
SF5: 16
SF6: 32

According to luminance levels expressed by an input video signal, light emission is selectively performed in each of the subfields SF1 to SF6. In this process, the intermediate luminance corresponding to the sum of the light emission periods performed during one field period (SF1 to SF6) is viewed. For example, when a display cell emits light in only the subfield SF6 of the subfields SF1 to SF6, the display cell emits light only for a period corresponding to "32" in one field. Therefore, an intermediate luminance corresponding to "32" is viewed. In the meantime, when a display cell emits light in each of the subfields SF1 to SF5, except for the subfield SF6, the display cell emits light for a period corresponding to "31" (="1"+"2"+"4"+"8"+"16") in one field. Therefore, an intermediate luminance corresponding to "31" is viewed.

In this case, with the six subfields, 64 combinations (light emission patterns) of subfields to emit light and subfields not to emit light are obtained. With the 64 light emission patterns, 64 combinations of light emission periods in one field are obtained. Therefore, it is possible to express intermediate luminance corresponding to each of 64 grayscales.

Here, for example, in one field, a light emission period and a blackout period of a display cell G31 corresponding to a pixel for expressing luminance "32" are reverse to those of a display cell G32 corresponding to a pixel for expressing luminance "31" (see FIG. 1 of Patent Document 1). Therefore, in a case of seeing the screen of the PDP, if one sees the display cell G32 in periods of SF1 to SF5 and then moves the sight to the display cell G31 as shown by a broken line in FIG. 1, one continuously sees only the blackout periods of both of them. As a result, a dark line is viewed on a boundary between them as a false contour, thereby degrading the image quality.

Further, a driving method was proposed in which a display cell lights in the continuous subfields the number of times corresponding to luminance to be express and then maintains a blackout state until reaching the subfield SF6 (see FIG. 2 of Patent Document 1). According to this driving method, light emission patterns whose relationships between a light emission period and a blackout period are reverse to each other in one filed do not exist. Therefore, the above-mentioned false contour is not generated.

However, when a driving pulse for generating the discharge is applied to one of adjacent display cells and is not applied to the other, since these display cells suffer interference of an electric field from each other, some cases where discharge is not correctly generated occur. In order to prevent such a case from occurring, according to the above-mentioned driving method, even a display cell once shifted to a blackout state is repeatedly supplied with a driving pulse for generating discharge to shift the display cell to the blackout state. For this reason, there has been a problem that the power consumption is relatively high even at the time of low luminance display.

SUMMARY OF THE INVENTION

The invention has been finalized to solve the problem above, and it is an object of the invention to provide a method of driving a display panel that can reduce the power consumption.

According a first aspect of the invention, there is provided a method of driving a display panel, in which a plurality of pixels are arranged in a matrix and each pixel includes a plurality of display cells emitting different color light, to perform grayscale display in a plurality of subfields of each unit display period. This driving method includes: initializing all the display cells in a lighting mode in a first subfield of the unit display period; and performing a first selective erase operation, a second selective erase operation, and a sustain operation in the unit display period. The first selective erase operation changes the display cells from the lighting mode to a blackout mode in one subfield according to a luminance level expressed by an input video signal. The second selective erase operation changes the display cells into the blackout mode again in at least one of subfields subsequent to the one subfield. The sustain operation makes only the display cells being in the lighting mode emit light by the number of times corresponding to the luminance weight of the subfield. In this driving method, in the unit display period, the number of times of the second selective erase operation which is performed in one display cell of the pixel is different from the number of times of the second selective erase operation which is performed in another display cell emitting light of different color from that of the one display cell.

Further, according to a second aspect of the invention, there is provided a method of driving a display panel, in which a plurality of pixels are arranged in a matrix and each pixel includes a plurality of display cells emitting different color light, to perform grayscale display in a plurality of subfields of each unit display period. This driving method includes: initializing all the display cells in a lighting mode in a first subfield of the unit display period; and performing a first selective erase operation, a second selective erase operation, and a sustain operation in the unit display period. The first selective erase operation changes the display cells from the lighting mode to a blackout mode in one subfield according to a luminance level expressed by an input video signal. The second selective erase operation changes the display cells into the blackout mode again in at least one of subfields subsequent to the one subfield. The sustain operation makes only the display cells being in the lighting mode emit light by the number of times corresponding to the luminance weight of the subfield. According to this driving method, in the one subfield, when each display cell adjacent to the display cell which is a target of the first erase operation is in the blackout mode, the second erase operation is performed on the adjacent display cell.

Furthermore, according to a third aspect of the invention, there is provided a method of driving a display panel, in which a plurality of pixels are arranged in a matrix and each pixel includes a plurality of display cells emitting different color light, to perform grayscale display in a plurality of subfields of each unit display period. This driving method includes: initializing all the display cells in a lighting mode in a first subfield of the unit display period; and performing a first selective erase operation, a second selective erase operation, and a sustain operation in the unit display period. The first selective erase operation changes the display cells from the lighting mode to a blackout mode in one subfield according to a luminance level expressed by an input video signal. The second selective erase operation changes the display cells into the blackout mode again in at least one of subfields subsequent to the one subfield. The sustain operation makes only the display cells being in the lighting mode emit light by the number of times allocated to each of the subfields. In this driving method, according to an average luminance level of the input video signal, the number of times allocated to each of the subfields is changed and the subfields in which the second selective erase operation is performed is changed.

In the unit display period, the number of times of the second and subsequent selective erase operations which is performed in one display cell of the pixel is set to be different from the number of times of the second and subsequent selective erase operations which are performed in another display-cell emitting light of different color from that of the one display cell.

BRIEF DESCRIPTION OF THE DRAWINGS

FIG. 4 is a view showing the data conversion table A that is used to generate pixel driving data corresponding to a blue display cell, and light emission drive patterns;

FIG. 5 is a view showing a data conversion table B that is used to generate pixel driving data corresponding to a red/green display cell, and a light emission drive pattern;

FIG. 8 is a view illustrating a light emission drive pattern of each of adjacent display cells $C_{R1}$, $C_{G1}$, $C_{B1}$, $C_{R2}$, $C_{G2}$, and $C_{B2}$;

FIG. 10 is a view illustrating a light emission drive pattern of each of display cells $C_{R1}$, $C_{G1}$, $C_{B1}$, $C_{R2}$, $C_{G2}$, and $C_{B2}$ in the plasma display device shown in FIG. 9;

FIG. 12 is a view showing a data conversion table A that is used in a pixel-driving-data generating circuit 24 shown in FIG. 11, and light emission drive patterns;

FIG. 13 is a view showing a data conversion table B that is used in the pixel-driving-data generating circuit 24 shown in FIG. 11, and light emission drive patterns;

FIG. 14 is a view illustrating a light emission drive pattern of each of display cells $C_{R1}$, $C_{G1}$, $C_{B1}$, $C_{R2}$, $C_{G2}$, and $C_{B2}$ in the plasma display device shown in FIG. 11; and FIG. 15 is a view illustrating another light emission drive pattern of each of display cells $C_{R1}$, $C_{G1}$, $C_{B1}$, $C_{R2}$, $C_{G2}$, and $C_{B2}$ in the plasma display device shown in FIG. 11.

DETAILED DESCRIPTION OF THE INVENTION

Hereinafter, embodiments of the invention will be described.

Figure 1:
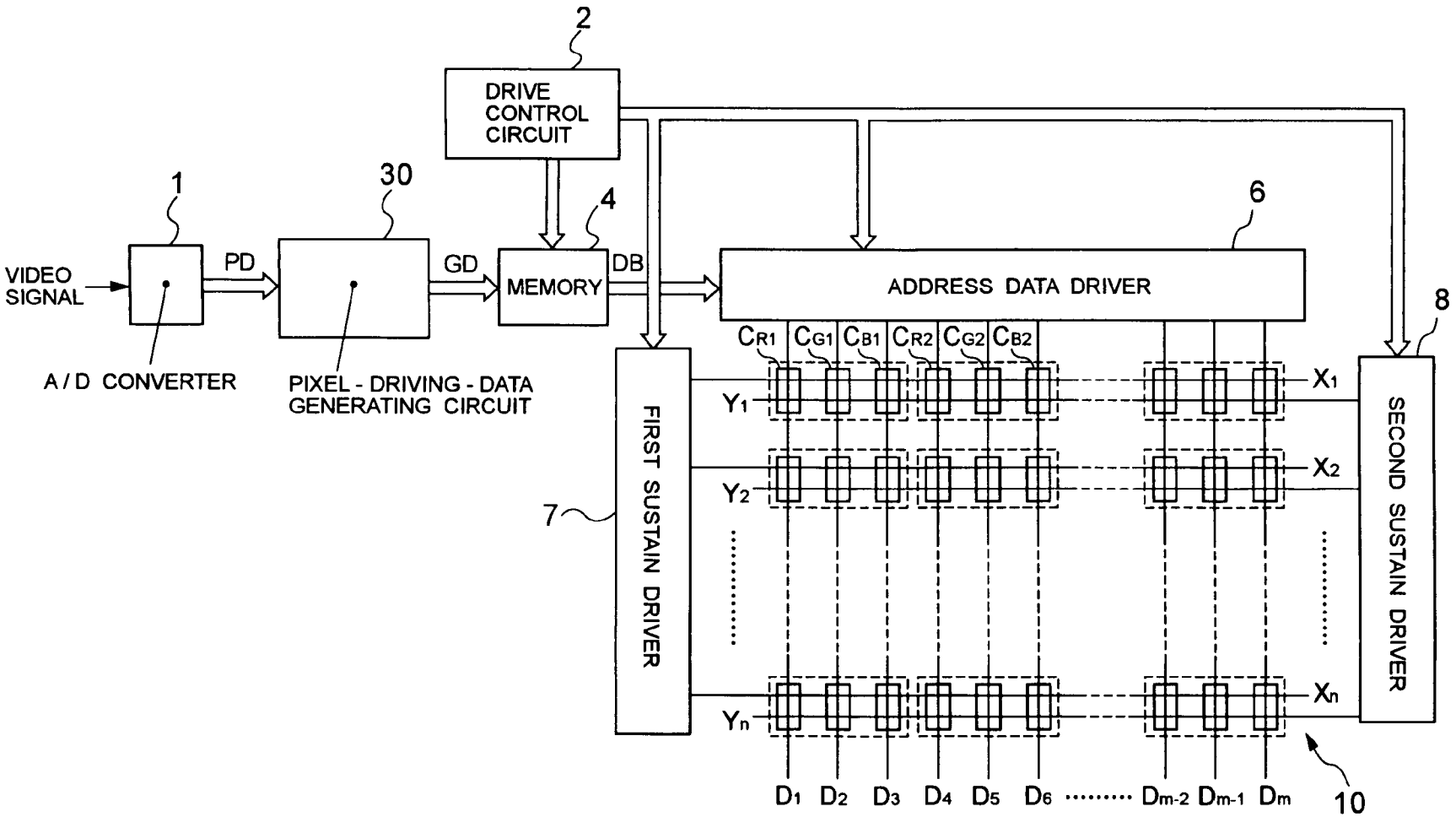
FIG. 1 is a view showing the configuration of a plasma display device driving a plasma display panel according to a driving method of the invention.

FIG. 1 is a view schematically showing the construction of a plasma display device that drives a plasma display panel according to a driving method of the invention.

The plasma display device includes a driving unit and a PDP 10 serving as a plasma display panel, and the driving unit has an A/D converter 1, a drive control circuit 2, a memory 4, an address driver 6, a first sustain driver 7, a second sustain driver 8, and a pixel-driving-data generating circuit 30.

The PDP 10 includes m column electrodes D1 to Dm, and n row electrodes X1 to Xn and n row electrode Y1 to Yn each disposed to intersect with the column electrodes D1 to Dm. The m column electrodes D1 to Dm include column electrodes D1, D4, D7, . . . , and Dm-2 for red light emission drive, column electrodes D2, D5, D8, . . . , and Dm-1 for green light emission drive, and column electrodes D3, D6, D9, . . . , Dm for blue light emission drive. Each pair of row electrodes Xi ($1 \leqq i \leqq n$) and Yi ($1 \leqq i \leqq n$) of the row electrodes X1 to Xn and the row electrodes Y1 to Yn has charge of first to n-th display lines of the PDP 10. A discharge space where discharge gas is enclosed is formed between the column electrode D and row electrodes X and Y, and display cells are formed at the intersections of the row electrodes and the column electrodes including the discharge space. In particular, display cells CR, emitting red light at the time of discharge, are formed on the column electrodes D1, D4, D7, . . . , Dm-2. Further, display cells CG, emitting green light at the time of discharge, are formed on the column electrode D3, D6, D9, . . . , and Dm. Furthermore, display cells CB, emitting blue light at the time of discharge, are formed on the column electrodes D3, D6, D9, . . . , and Dm. In this case, three display cells CR, CG, and CB, which are adjacent to each other in a horizontal direction of a screen, form a pixel cell having charge of display of one pixel.

The A/D converter 1 samples an analog input video signal, converts the sampled signal into, for example, 8-bit image data PD corresponding to each pixel, and supplies the image data PD to the pixel-driving-data generating circuit 30.

Figure 2:
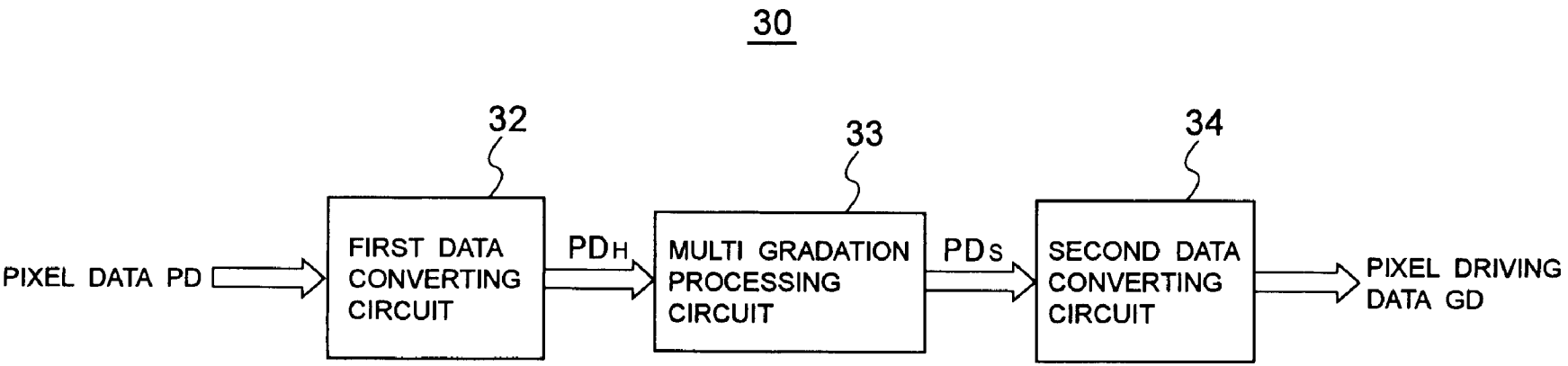
FIG. 2 is a view showing the inner configuration of a pixel-driving-data generating circuit 3 shown in FIG. 1.

FIG. 2 is a view showing the inner construction of the pixel-driving-data generating circuit 30.

Figure 3:
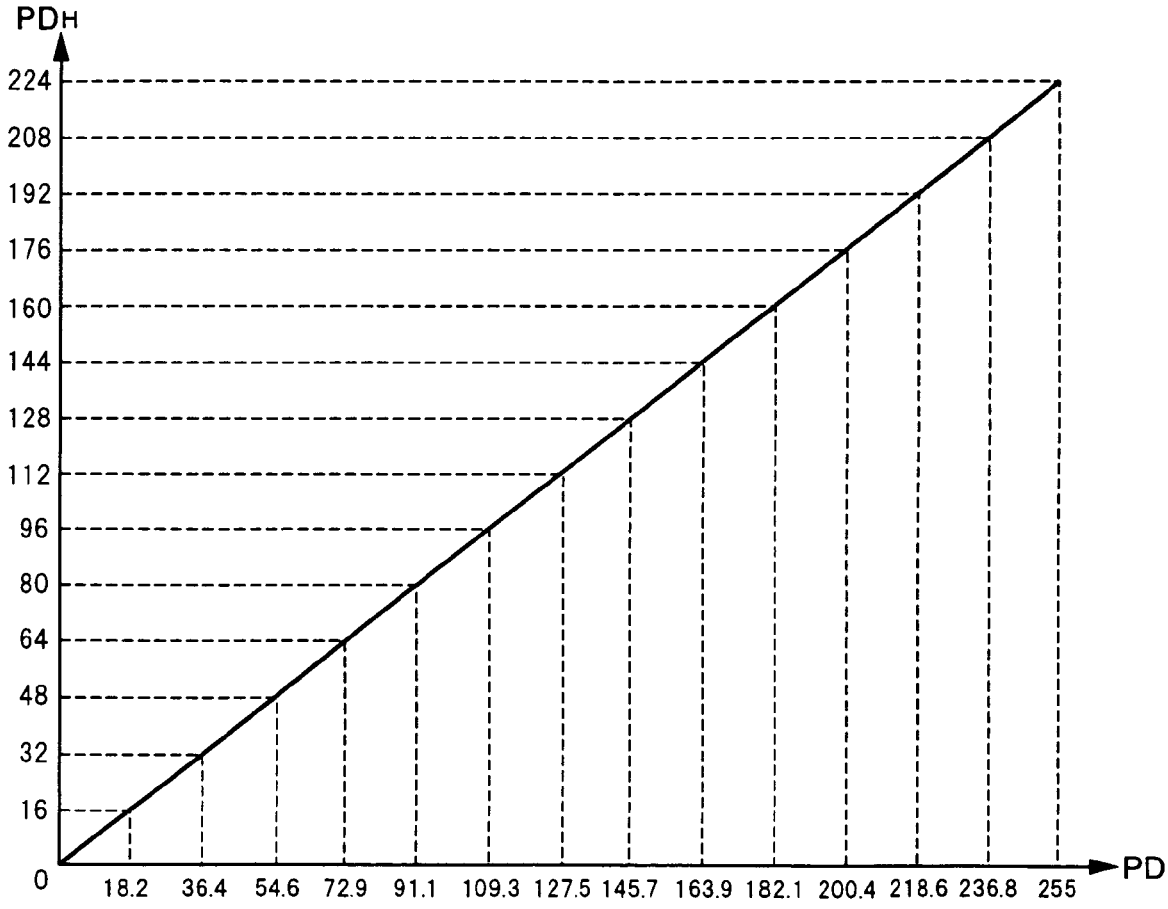
FIG. 3 is a view illustrating a drive state according to a data conversion table for pixel driving data conversion, and light emission drive patterns A.

In FIG. 2, a first data converting circuit 32 converts the image data PD, which can express from '0' to '255' in 8 bits, into 8-bit luminance conversion pixel data $PD_H$, which can express from '0' to '224' in 8 bits, on the basis of a conversion characteristic shown in FIG. 3, and supplies the converted data to a multi gradation processing circuit 33. By the data conversion of the first data converting circuit 32, it is possible to prevent generation of luminance saturation at the time of a multi gradation process (which will be described below) and to prevent generation of a flat part of a display characteristic (that is, occurrence of gray scale distortion) when display gray scale is not at a bit boundary.

The multi gradation processing circuit 33 performs an error diffusion process and a dither process on the 8-bit luminance conversion pixel data $PD_H$ so as to generate multi gradation pixel data $PD_S$ whose bit number is reduced to 4 bits while maintaining the current number of grayscale levels. For example, in the error diffusion process, first, the six upper bits of the luminance conversion pixel data $PD_H$ are set as display data and the two remaining lower bits are set as error data. Data obtained by-weighting and adding error data of the luminance conversion pixel data $PD_H$ corresponding to neighboring pixels is reflected to the display data. In this way, a pseudo luminance of two lower bits of an original pixel is expressed by the neighboring pixels and thus the same gray-scale level as that of the 8-bit pixel data can be expressed by six bit display data fewer than the 8-bit pixel data. Then, the dither process is performed on the 6-bit error diffusion process pixel data obtained by the error diffusion process. In the dither process, a plurality of neighboring pixels is set as a pixel unit, different dither coefficients are allocated to the error diffusion process pixel data corresponding to pixels in one pixel unit, and the results are added, thereby obtaining dither addition pixel data. By the addition of the dither coefficients, in the one pixel unit, the luminance corresponding to 8 bits can be expressed by only the four upper bits of the dither addition pixel data. Then, the multi gradation processing circuit 33 supplies the four upper bits of the dither addition pixel data to the second data converting circuit 34 as multi gradation pixel data $PD_S$. That is, multi gradation pixel data $PD_S$ of one screen (n rows×m columns) corresponding to the individual pixel cells C of the PDP 10 is supplied to the second data converting circuit 34.

The second data converting circuit 34 converts a part of the multi gradation pixel data $PD_S$ corresponding to the blue display cells CB into 14-bit pixel driving data GD in accordance with a data conversion table A shown in FIG. 4 and supplies the converted data to the memory 4. Further, the second data converting circuit 34 converts a part of the multi gradation pixel data $PD_S$ corresponding to the red pixel cells CR or the green display cell CG into 14-bit pixel driving data GD in accordance with a data conversion table B shown in FIG. 5 and supplies the converted data to the memory 4.

The memory 4 sequentially writes the 14-bit pixel driving data GD according to a writing signal supplied from the drive control circuit 2. When the 14-bit pixel driving data corresponding to one screen (n rows×m columns) is completely written, the memory 4 reads the written data according to a reading signal supplied from the drive control circuit 2 as the follows.

First, the memory 4 looks on the written individual pixel driving data GD for-one screen as pixel driving data bits DB1 to DB14 divided into individual bits (first to 14th bits).

Namely, the memory 4 interprets as follows:

DB1(1,1) to DB1(n,m): First bits of GD(1,1) to GD(n,m)
DB2(1,1) to DB2(n,m): Second bits of GD(1,1) to GD(n,m)
DB3(1,1) to DB3(n,m): Third bits of GD(1,1) to GD(n,m)
DB4(1,1) to DB4(n,m): Fourth bits of GD(1,1) to GD(n,m)
DB5(1,1) to DB5(n,m): Fifth bits of GD(1,1) to GD(n,m)
DB6(1,1) to DB6(n,m): Sixth bits of GD(1,1) to GD(n,m)
DB7(1,1) to DB7(n,m): Seventh bits of GD(1,1) to GD(n,m)
DB8(1,1) to DB8(n,m): Eighth bits of GD(1,1) to GD(n,m)
DB9(1,1) to DB9(n,m): Ninth bits of GD(1,1) to GD(n,m)
DB10(1,1) to DB10(n,m): Tenth bits of GD(1,1) to GD(n,m)
DB11(1,1) to DB11(n,m): Eleventh bits of GD(1,1) to GD(n,m)
DB12(1,1) to DB12(n,m): Twelfth bits of GD(1,1) to GD(n,m)
DB13(1,1) to DB13(n,m): Thirteenth bits of GD(1,1) to GD(n,m)
DB14(1,1) to DB14(n,m): Fourteenth bits of GD(1,1) to GD(n,m)

Further, the memory 4 reads the pixel driving data bits DB1(1,1) to DB1(n,m) display line by display line in an address period Wc in a subfield SF1 described later, and supplies the read data bits to the address driver 6. Then, the memory 4 reads the pixel driving data bits DB2(1,1) to DB2(n,m) display line by display line in an address period Wc in a subfield SF2 described later, and supplies the read data bits to the address driver 6. In the same way, the memory 4 reads the pixel driving data bits DB3 to DB14 display line by display line in address periods Wc in subfields SF3 to SF14 described later, and supplies the read data bits to the address driver 6.

Figure 6:
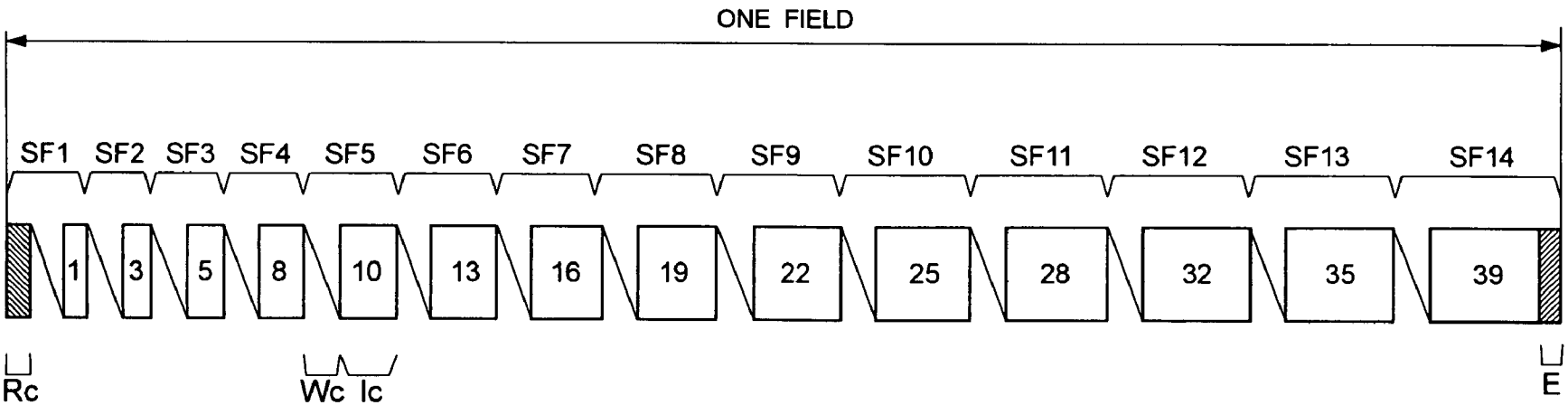
FIG. 6 is a view showing a light emission driving sequence at the time of driving the PDP 10 shown in FIG. 1.

The drive control circuit 2 supplies the address driver 6, the first sustain driver 7, and the second sustain driver 8 with various timing signals for driving and controlling the PDP 10 in accordance with a light emission drive format on the basis of the subfield method shown in FIG. 6.

In the light emission drive format shown in FIG. 6, every one field or the display period of one frame, that is, each unit display period is divided into 14 subfields SF1 to SF14 each including an address period Wc and a sustain period Ic. In the address period Wc, each of the display cells in the PDP 10 is set to either a lighting mode or a blackout mode according to the pixel driving data bits DB. Further, in the sustain period Ic, only the display cells in the lighting mode are turned on the same number of times as the numbers described as a ratio in FIG. 6. Further, the first subfield SF1 has also a reset period Rc when a wall charge amount in all the display cells of the PDP 10 is initialized, and the last subfield SF14 has also an erase period E when the wall charge in all the display cells is erased at the same time.

Figure 7:
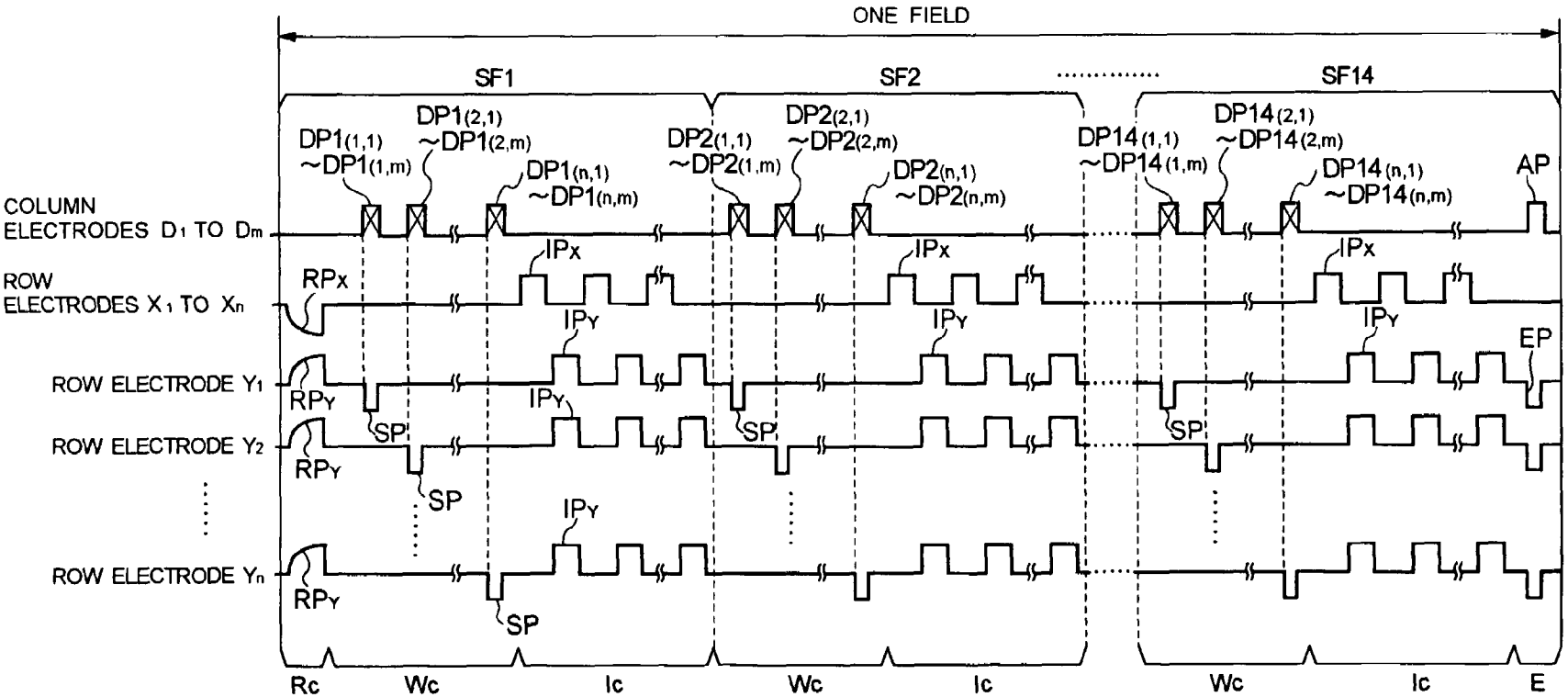
FIG. 7 is a view showing various driving pulses applied to the PDP 10 shown in FIG. 1.

FIG. 7 is a view showing various pluses which are applied from the address driver 6, the first sustain driver 7, and the second sustain driver 8 to the PDP 10 according to the various timing signals supplied from the drive control circuit 2 in the reset period Rc, the address periods Wc, the sustain periods Ic, and the erase address E.

First, in the reset period Rc, the first sustain driver 7 and the second sustain driver 8 apply reset pulses RPX and RPY having waveforms shown in FIG. 7 to the row electrodes X1 to Xn and Y1 to Yn of the PDP 10. When these reset pulses RPX and RPY are applied, all the display cells in the PDP are discharged (reset). Immediately after the discharge (reset), a predetermined amount of wall charge is uniformly formed in each of the display cells. Through the reset discharge, all the display cells are initialized to the lighting mode.

Next, in the address period Wc of each subfield, the address driver 6 generates a pixel data pulse having a voltage corresponding to the logic level of the pixel driving data bit DB supplied from the memory 4. For example, the address driver 6 generates a pixel data pulse having a predetermined positive high voltage when the logic level of the pixel driving data bit is '1' and generates a pixel data pulse DP having a low voltage (zero volt) when the logic level is '0'. Then, the address driver 6 applies the generated pixel data pulses DP to the (m) column electrodes D1 to Dm for each of the rows. For example, in the address period Wc of the subfield SF1, the pixel driving data bits DB1(1,1) to DB1(n,m) are supplied from the memory 4. Therefore, the address driver 6 first extracts the pixel driving data bits corresponding to a first row, that is, DB1(1,1) to DB1(1,m) from the pixel driving data bits DB1(1,1) to DB1(n,m). Then, the address driver 6 converts the m pixel driving data bits DB1(1,1) to DB1(1,m) into m pixel data pulses DP1(1,1) to DP1(1,m) corresponding to the logic levels of the pixel driving data bits DB1(1,1) to DB1(1,m), respectively, and applies the m pixel data pulses to the column electrodes D1 to Dm at the same time as shown in FIG. 7. Next, the address driver 6 extracts the m pixel driving data bits DB(2,1) to DB1(2,m) corresponding to a second row from the pixel driving data bit group DB1. Then, the address driver 6 converts the m pixel driving data bits DB(2,1) to DB1(2,m) into m pixel data pulses DP1(2,1) to DP1(2,m) corresponding to the logic levels of the pixel driving data bits DB(2,1) to DB1(2,m), respectively, and applies the m pixel data pulses to the column electrodes D1 to Dm at the same time as shown in FIG. 7. In the same way, in the address period Wc of each subfield SF1, the address driver 6 applies the pixel data pulse DP1, corresponding to the pixel driving data bits DB1 supplied from the memory 4, to the column electrodes D1 to Dm for each row.

Further, in the address period Wc, the second sustain driver 8 generates negative scanning pulses SP shown in FIG. 7 at the same timings as the timings when the pixel data pulses DP are applied for each row, and sequentially applies the generated scanning pulses to the row electrodes Y1 to Yn. At this time, selective erase discharge occurs in only the display cells located at the intersections of the row electrodes where the scanning pluses SP are applied and the column electrodes where the high-voltage pixel data pulses are applied such that the wall charge remaining in the display cells is selectively erased. This selective erase discharge causes the display cells, which were initialized to the lighting mode in the reset period Rc, to be set to the blackout mode. Meanwhile, selective erase discharge does not occur in the display cells where the scanning pulses SP are applied and the low-voltage (zero voltage) pixel data pulses are applied. Therefore, these display cells maintain the state immediately before. Namely, the display cells in the lighting mode maintain the lighting mode and the display cells in the blackout mode maintain the blackout mode.

Next, in the sustain period Ic of each subfield, the first sustain driver 7 and the second sustain driver 8 apply sustain pulses IPX and IPY, which have alternately a positive polarity as shown in FIG. 7, to the row electrodes X1 to Xn and Y1 to Yn, respectively. Further, in the sustain period Ic of each of the subfields SF1 to SF14, the number for repeating the supply of the sustain pulse IP is allocated in advance according to a luminance weight of the subfield. In order words, when the number of the supply is "1" in SF1, the following numbers of the pulses are applied in the subfields as shown in FIG. 6.

SF1: 1
SF2: 3
SF3: 5
SF4: 8
SF5: 10
SF6: 13
SF7: 16
SF8: 19
SF9: 22
SF10: 25
SF11: 28
SF12: 32
SF13: 35
SF14: 39

In this process, sustain discharge occurs in only the display cells where the wall charge remains, that is the display cells in the lighting mode are discharged for sustaining whenever the sustain pulses IPX and IPY are applied, and sustain the light emission state caused by the sustain discharge during the number of the discharges assigned to each of the subfields.

On the basis of the pixel driving data GD shown in FIG. 4 or 5, it is determined whether each of the display cells is set to the lighting mode in each subfield and sustain discharge occurs in the subfield.

That is, according to the pixel driving data GD, first, as shown by a light emission pattern in FIG. 4 or 5, a first selective erase discharge occurs in the address period W of the first subfield (shown by a black circle) according to a luminance level to be expressed. At this time, on the basis of driving according to a light emission pattern in FIG. 6, a chance of changing the display cells from the blackout mode to the lighting mode is in only the reset period Rc of the subfield SF1. Therefore, when the first selective erase discharge occurs in the subfield shown by the black circle in FIG. 4 or 5, the lighting mode is maintained from the next subfield to the last subfield SF 14 and light is continuously emitted due to the sustain discharge in the individual subfields (as shown by white circles). In this way, an intermediate luminance corresponding to the total number of sustain discharges in the sustain period I of each of the subfields SF1 to SF14 is viewed. In other words, according to the pixel driving data GD, one of fifteen light emission drive pattern shown in FIG. 4 or 5 is selectively performed, intermediate luminances in fifteen grayscale levels, which have a luminance ratio of {0, 1, 4, 9, 17, 27, 40, 56, 75, 97, 122, 150, 182, 217, 255}, are represented.

In the driving showing in FIG. 4 or 5, the first selective erase discharge occurs in the address period of the first subfield (shown by a black circle) according to a luminance level to be expressed. In other words, in the address period Wc of the subfield, the positive high-voltage pixel data pluses for generating the selective erase discharge are applied to the column electrodes while the scanning pulses SP are applied to the row electrodes. However, even though the positive high-voltage pixel data pulses are applied to the column electrodes, there are some cases where the first selective erase discharge is not correctly generated. Therefore, in the driving shown in FIG. 4 or 5, even after the driving is performed such that the first selective erase discharge (shown by the black circle) occurs, second and subsequent selective erase discharges (shown by black triangles) repeatedly occur in the subsequent subfields. In other words, in the address period Wc of each of these subsequent subfields, the positive high-voltage pixel data pulses are applied to the column electrodes such that the selective erase discharges occur.

In this process, after the display cells CB, having charge of blue light emission among the display cells of the PDP 10, are driven to generate the first selective erase discharge shown in FIG. 4, they are driven to repeatedly generate the second and subsequent selective erase discharges (shown by the black triangles) in the address periods Wc to the last subfield SF14. Meanwhile, the display cells CR or CG having charge of red or blue light emission are driven to generate the first selective erase discharge shown in FIG. 5, and then they are driven to repeatedly generate the second and subsequent selective erase discharges (shown by the black triangles) in the address periods Wc of two subsequent subfields.

The operation when the above-mentioned driving has been performed will be described below with regard to the display cells $C_{R1}$, $C_{G1}$, $C_{B1}$, $C_{R2}$, $C_{G2}$, and $C_{B2}$ that are formed at the intersections of the first display lines (row electrodes X1 and Y1) and the column electrodes D1 to D6 in the PDP 10 shown in FIG. 1.

FIG. 8 is a view showing light emission drive patterns when the six display cells $C_{R1}$, $C_{G1}$, $C_{B1}$, $C_{R2}$, $C_{G2}$, and $C_{B2}$ emit light components having the intermediate luminance levels '4', '40', '9', '27', '9', and '4' of the above-mentioned fifteen grayscale levels composed of {0, 1, 4, 9, 17, 27, 40, 56, 75, 97, 122, 150, 182, 217, 255}, respectively, that is, when light emission driving is performed so as to be the followings:

$C_{R1}$: luminance level '4'
$C_{G1}$: luminance level '40'
$C_{B1}$: luminance level '9'
$C_{R2}$: luminance level '27'
$C_{B2}$: luminance level '9'
$C_{G2}$: luminance level '4'

First, when the display cells $C_{R1}$ and $C_{B2}$ emit light at a luminance level '4', multi gradation pixel data $PD_S$ of [0010] is supplied. At this time, the pixel driving data GD corresponding to the display cell $C_{R1}$, becomes [00111000000000] on the basis of a data conversion table B shown in FIG. 5. Meanwhile, the pixel driving data GD corresponding to the display cell $C_{B2}$ becomes [00111111111111] on the basis of the data conversion table A shown in FIG. 4. Therefore, according to the pixel driving data GD, the display cells $C_{R1}$ and $C_{B2}$ are sustain-discharged in the subfields SF1 and SF2 of the subfields SF1 to SF14 (as shown by white circles) and are driven to generate the first selective erase discharge (shown by a black circle) in the subfield SF3. Further, in the subfields following the subfield SF3, the display cells $C_{R1}$ and $C_{B2}$ are driven to generate the second and subsequent selective erase discharges (shown by black triangles). At this time, the display cell $C_{B2}$ is driven to generate the second and subsequent selective erase discharges in the individual subfields SF4 to SF14, while the display cell $C_{R1}$ is driven to generate the second and third selective erase discharges in the subfields SF4 and SF5, respectively.

Next, when the display cell $C_{G1}$ emits light at a luminance level '40', multi gradation pixel data $PD_S$ of [0110] is supplied. At this time, the pixel driving data GD corresponding to the display cell $C_{G1}$ becomes [00000011100000] on the basis of the data conversion table B shown in FIG. 5. Therefore, according to the pixel driving data GD, the display cell $C_{G1}$ is sustain-discharged in each of the subfields SF1 to SF6 of the subfields SF1 to SF14 (as shown by white circles) and is driven to generate the first selective erase discharge (shown by a black circle) in the subfield SF7. Further, in the subfields SF8 and SF9 following the subfield SF7, the display cell $C_{G1}$ is driven to generate the second and third selective erase discharges (shown by black triangles).

Subsequently, when the display cells $C_{B1}$ and $C_{G2}$ emit light at a luminance level '9', multi gradation pixel data $PD_S$ of [0011] is supplied. At this time, the pixel driving data GD corresponding to the display cell $C_{G2}$ becomes [00011100000000] on the basis of the data conversion table B shown in FIG. 5. Meanwhile, the pixel driving data GD corresponding to the display cell $C_{B1}$ becomes [00011111111111] on the basis of the data conversion table A shown in FIG. 4. Therefore, according to the pixel driving data GD, the display cells $C_{B1}$ and $C_{G2}$ are sustain-discharged in the subfields SF1 to SF3 of the subfields SF1 to SF14 (as shown by white circles) and are driven to generate the first selective erase discharge (shown by a black circle) in the subfield SF4. Further, in the subfields following the subfield SF4, the display cells $C_{B1}$ and $C_{G2}$ are driven to generate the second and subsequent selective erase discharges (shown by black triangles). At this time, the display cell $C_{B1}$ is driven to generate the second and subsequent selective erase discharges in the individual subfields SF5 to SF14, while the display cell $C_{G2}$ is driven to generate the second and third selective erase discharges in the subfields SF5 and SF6, respectively.

Next, when the display cell $C_{R2}$ emits light at a luminance level '27', multi gradation pixel data $PD_S$ of [0101] is supplied. At this time, the pixel driving data GD corresponding to the display cell $C_{R2}$ becomes [00000111000000] on the basis of the data conversion table B shown in FIG. 5. Therefore, according to the pixel driving data GD, the display cell $C_{R2}$ is sustain-discharged in each of the subfields SF1 to SF5 of the subfields SF1 to SF14 (as shown by white circles) and is driven to generate the first selective erase discharge (shown by a black circle) in the subfield SF6. Further, in the subfields SF7 and SF8 following the subfield SF6, the display cell $C_{R2}$ is driven to generate the second and third selective erase discharges (shown by black triangles).

In this way, the display cells $C_B$, having charge of emission of blue light having a relatively low light-emission luminance, of the display cells of the PDP 10 perform the first selective erase discharge and then is driven repeatedly to generate the second and subsequent selective erase discharges in the individual subfields to the last subfield SF14. However, the display cells $C_R$ and $C_G$, having charge of emission of red and green light having relatively higher light-emission luminances as compared to the blue light emission, perform the first selective erase discharge and then is driven two times so as to generate the second and subsequent selective erase discharges. Therefore, it is possible to reduce power consumption as compared to the case in which all the display cells are driven repeatedly to generate the second and subsequent selective erase discharges to the last subfield SF14 as shown in FIG. 4. Further, for example, even though the number of times to generate the second and subsequent selective erase discharges in the display cells $C_R$ and $C_G$ having charge of red and green light emission is small, since the display cells $C_B$ adjacent to the display cells $C_R$ and $C_G$ are driven to generate the second and subsequent selective discharges to reach the last subfield SF14, the possibility that interference of an electric field occurs decreases. For example, in FIG. 8, the display cell $C_{G1}$ is driven to generate the first selective erase discharge in the subfield SF7. During this time, the display cell $C_{R1}$ adjacent to one side of the display cell $C_{G1}$ is not driven to generate the second and subsequent selective erase discharges, while the pixel data pulse is applied to the display cell $C_{B1}$ adjacent to the other side of the display cell $C_{G1}$ so as to generate the fourth selective erase discharge. Therefore, the electric field from the display cell $C_{B1}$ adjacent to the display cell $C_{G1}$ does not interfere in the display cell $C_{G1}$, whereby it is possible to reliably generate the first selective erase discharge in the display cell $C_{G1}$.

In the above-mentioned embodiment, the number of times of the second and subsequent selective erase discharges performed on each of the display cells $C_R$ and $C_G$ having charge of red and green light emission is set to be smaller than the number of times of the second and subsequent selective erase discharges performed on the display cells $C_B$ having charge of blue light emission, but is not limited thereto. For example, the number of times the second and subsequent selective erase discharges performed on each of the display cells $C_B$ and $C_G$ having charge of blue and blue light emission may be set to be smaller than the number of times of the second and subsequent selective erase discharges performed on the display cells $C_R$ having charge of red light emission.

Further, in the above-mentioned embodiment, the subfields to generate the second and subsequent selective erase discharges are set to each of the display cells $C_R$, $C_G$, and $C_B$, but the display cells may be driven to generate the second and subsequent selective erase discharges according to the states of the adjacent display cells.

Figure 9:
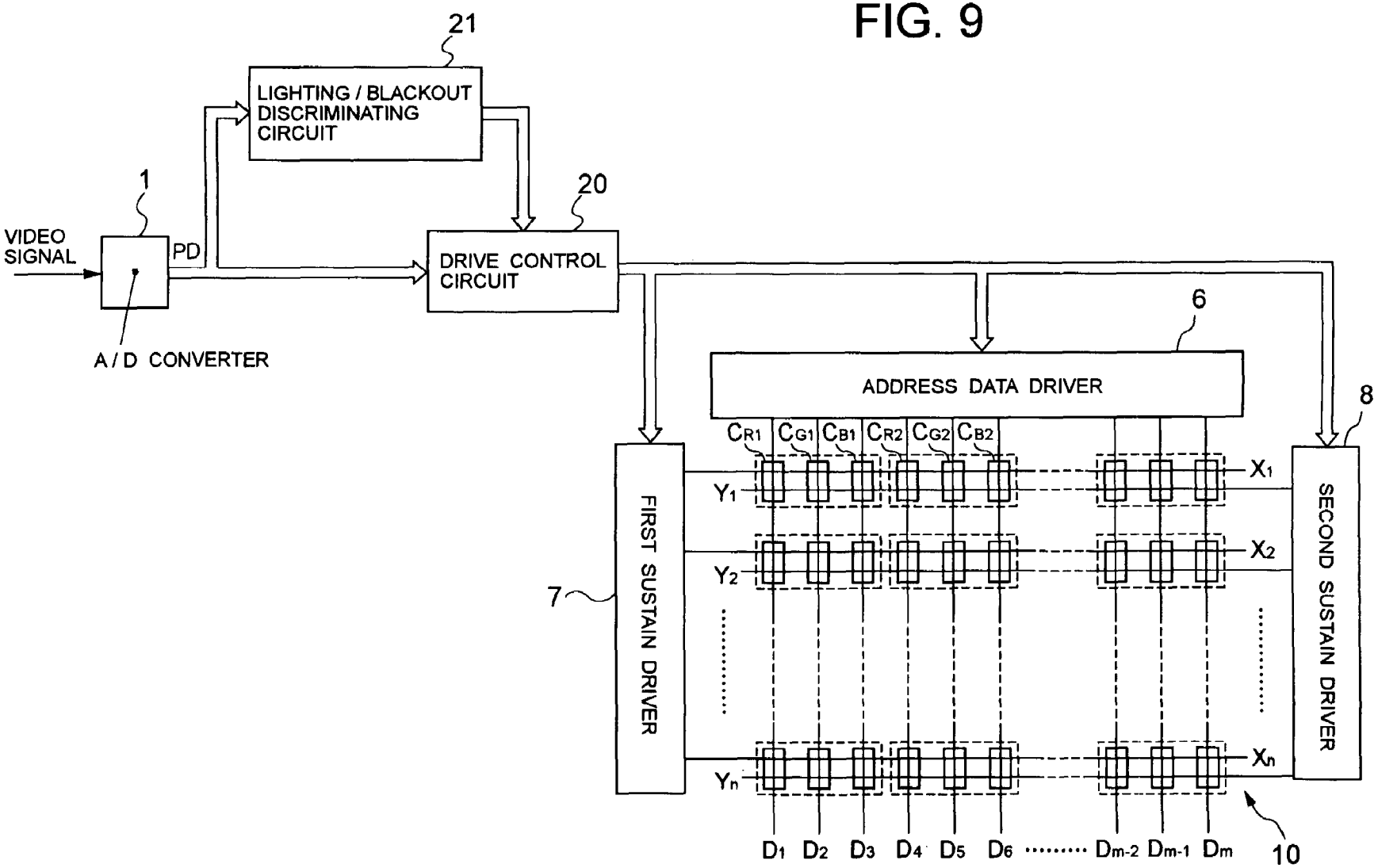
FIG. 9 is a view showing the configuration of a plasma display device driving a plasma display panel according to another driving method of the invention.

FIG. 9 is a view schematically showing the construction of a plasma display device driving a plasma display panel according to another driving method of the invention so as to perform grayscale display, the invention having been finalized in view of the drawbacks inherent in the related art.

In the plasma display device shown in FIG. 9, the operation of an A/D converter 1, an address driver 6, a first sustain driver 7, a second sustain driver 8, and a PDP 10 is the same as that in the plasma display device shown in FIG. 1.

Similar to the drive control circuit 2 shown in FIG. 1, a drive control circuit 20 supplies the address driver 6, the first sustain driver 7, and the second sustain driver 8 with various timing signals for driving the PDP 10 as shown in FIGS. 6 and 7 according to pixel data PD supplied from the A/D converter 1.

A lighting/blackout discriminating circuit 21 provides the drive control circuit 20 with a light/blackout discrimination signal showing whether each display cell is set to the light mode or the blackout mode in the address period Wc of each of the subfields SF1 to SF14 shown in FIG. 6 on the basis of the pixel data PD.

The drive control circuit 20 first detects the subfield in which each display cell generates the first selective erase discharge on the basis of the lighting/blackout discrimination signal. Next, the drive control circuit 20 supplies the address driver 6 with a signal to apply the positive high-voltage pixel data pulse to each display cell to generate the first selective erase discharge in the address period Wc of each subfield. At this time, the display cell to which the high-voltage pixel data pulse is applied by the address driver 6 generates the first selective erase discharge and is charged from the lighting mode to the blackout mode. Therefore, the display cell is sustain-discharged in the sustain period Ic of each subfield from the first subfield SF1 to the subfield in which the first selective erase discharge is generated. At this time, the intermediate luminance corresponding to the number of times of the sustain discharge generated during the subfields SF1 to SF14 is viewed.

Further, on the lighting/blackout discrimination signal, the drive control circuit 20 determines whether the display cell, adjacent to the right or left side of the display cell which generates the first selective erase discharge, is set to the light mode or the blackout mode in the subfield in which the first selective erase discharge is generated as described above. At this time, only when it is determined that the adjacent display cell is in the blackout mode, the drive control circuit 2 supplies the address driver 6 with a signal to apply the positive high-voltage pixel data pulse to the adjacent display cell to generate the second and subsequent selective erase discharges in the subfield. Therefore, in each of the subfields following the subfield in which each display cell generates the first selective erase discharge, the display cell adjacent to the right or left side is driven to generate the second and subsequent selective erase discharges in only the subfield in which the first selective discharge is generated.

FIG. 10 is a view illustrating the above-mentioned operation by using six display cells $C_{R1}$, $C_{G1}$, $C_{B1}$, $C_{R2}$, $C_{G2}$, and $C_{B2}$ adjacent to each other on one line. FIG. 10 also shows the light emission drive pattern when the display cells emit light components having the following luminances:

$C_{R1}$: luminance level '4'
$C_{G1}$: luminance level '40'
$C_{B1}$: luminance level '9'
$C_{R2}$: luminance level '27'
$C_{B2}$: luminance level '9'
$C_{G2}$: luminance level '4'

First, when the display cell $C_{R1}$ emits light at a luminance level '4', as shown in FIG. 10, the first selective erase discharge (shown by a black circle) is generated in the address period Wc of the subfield SF3. Therefore, the display cell $C_{R1}$ becomes the lighting mode in only the subfields SF1 and SF2 of the subfields SF1 to SF14 and the sustain discharge (shown by a white circle) is continuously generated in the sustain period Ic of each of the subfields SF1 and SF2. Then, the display cell $C_{R1}$ maintains the blackout mode over the subfields SF3 to SF14.

When the display cell $C_{G1}$ emits light at a luminance level '40', as shown in FIG. 10, the first selective erase discharge (shown by a black circle) is generated in the address period Wc of the subfield SF7. Therefore, the display cell $C_{G1}$ becomes the lighting mode over the subfields SF1 to SF6 and the sustain discharge (shown by a white circle) is continuously generated in the sustain period Ic of each of the subfields SF1 to SF6. Then, the display cell $C_{G1}$ maintains the blackout mode over the subfields SF7 to SF14.

When the display cell $C_{B1}$ emits light at a luminance level '9', as shown in FIG. 10, the first selective erase discharge (shown by a black circle) is generated in the address period Wc of the subfield SF4. Therefore, the display cell $C_{B1}$ becomes the lighting mode over the subfields SF1 to SF3 and the sustain discharge (shown by a white circle) is continuously generated in the sustain period Ic of each of the subfields SF1 to SF3. Then, the display cell $C_{B1}$ maintains the blackout mode over the subfields SF4 to SF14.

When the display cell $C_{R2}$ emits light at a luminance level '27', as shown in FIG. 10, the first selective erase discharge (shown by a black circle) is generated in the address period Wc of the subfield SF6. Therefore, the display cell $C_{R2}$ becomes the lighting mode over the subfields SF1 to SF5 and the sustain discharge (shown by a white circle) is continuously generated in the sustain period Ic of each of the subfields SF1 to SF5. Then, the display cell $C_{R2}$ maintains the blackout mode over the subfields SF6 to SF14.

When the display cell $C_{G2}$ emits light at a luminance level '9', as shown in FIG. 10, the first selective erase discharge (shown by a black circle) is generated in the address period Wc of the subfield SF4. Therefore, the display cell $C_{G2}$ becomes the lighting mode over the subfields SF1 to SF3 and the sustain discharge (shown by a white circle) is continuously generated in the sustain period Ic of each of the subfields SF1 to SF3. Then, the display cell $C_{G2}$ maintains the blackout mode over the subfields SF4 to SF14.

Here, both the display cells $C_{R1}$ and $C_{B1}$ adjacent to the display cell $C_{G1}$ are in the blackout mode in the subfield SF7 in which the display cell $C_{G1}$ generates the first selective erase discharge. Therefore, in the address period Wc of the subfield SF7, the positive high-voltage pixel data pulses are applied to the display cells $C_{R1}$ and $C_{B1}$ so as to generate the second and subsequent selective erase discharges (shown by black triangles). Further, in the subfield SF6 in which the display cell $C_{R2}$ generates the first selective erase discharge, both the display cells $C_{B1}$ and $C_{G2}$ adjacent to the display cell $C_{R2}$ are in the blackout mode. Therefore, in the address period Wc of the subfield SF6, the positive high-voltage pixel data pulses are applied to the display cells $C_{B1}$ and $C_{G2}$ so as to generate the second and subsequent selective erase discharges (shown by black triangles).

According to the driving, during the display cell is driven to generate the first selective erase discharge, the pixel data pulses should be applied to the display cells adjacent to the display cell so as to generate the second selective erase discharge. Therefore, the interference of an electric field from the adjacent display pixels is prevented. Further, since the number of times of driving for generating the second and subsequent selective erase discharges is smaller as compared to the case of performing drive as shown in FIG. 4 or 5, it is possible to further reduce the power consumption.

Figure 11:
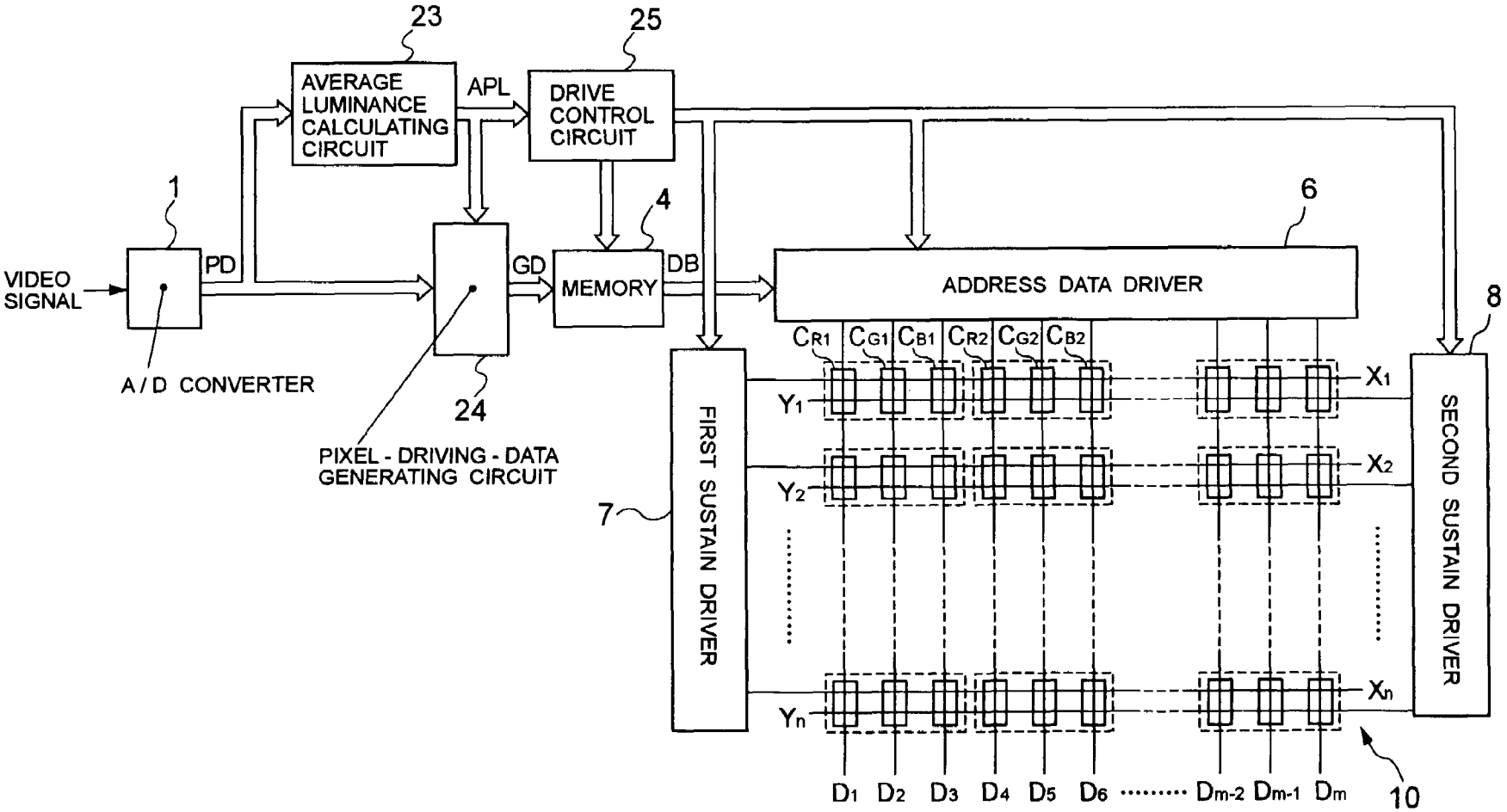
FIG. 11 is a view showing the configuration of a plasma display device driving a plasma display panel according to a further driving method of the invention.

FIG. 11 is a view schematically showing the schematic construction of a plasma display device driving a plasma display panel according to a further driving method of the invention so as to perform grayscale display.

In the plasma display device shown in FIG. 11, the operation of an A/D converter 1, a memory 4, an address driver 6, a first sustain driver 7, a second sustain driver 8, and a PDP 10 is the same as that in the plasma display device shown in FIG. 1.

In FIG. 11, an average luminance calculating circuit 23 calculates an average luminance level of each image frame (or each field) due to input video signals on the basis of the pixel data PD, and supplies a pixel-driving-data generating circuit 24 and a drive control circuit 25 with an average luminance signal APL showing the average luminance level.

The pixel-driving-data generating circuit 24 first converts the pixel data PD, which can express from '0' to '255' in 8 bits, into 8-bit luminance conversion pixel data $PD_H$, which can express from '0' to '224' in 8 bits, on the basis of a conversion characteristic shown in FIG. 3. By the conversion, it is possible to prevent generation of luminance saturation at the time of a multi gradation process to be described below and to prevent generation of a flat part of a display characteristic (that is, occurrence of gray scale distortion) when display gray scale is not at a bit boundary. Next, the pixel-driving-data generating circuit 24 performs an error diffusion process and a dither process on the 8-bit luminance conversion pixel data $PD_H$ so as to generate multi gradation pixel data $PD_S$ whose bit number is reduced to 4 bits while maintaining the current number of grayscale levels. For example, in the error diffusion process, first, the six bits of the luminance conversion pixel data $PD_H$ are set as display data and the two remaining lower bits are set as error data. Data obtained by weighting and adding error data of the luminance conversion pixel data $PD_H$ corresponding to neighboring pixels is reflected to the display data. In this way, a pseudo luminance of two lower bits of an original pixel is expressed by the neighboring pixels and thus the same grayscale level as that of the 8-bit pixel data can be expressed by six bit display data fewer than the 8-bit pixel data. Then, the dither process is performed on the 6-bit error diffusion process pixel data obtained by the error diffusion process. In the dither process, a plurality of neighboring pixels is set as a pixel unit, different dither coefficients are allocated to the error diffusion process pixel data corresponding to pixels in one pixel unit, and the results are added, whereby dither addition pixel data is obtained. By the addition of the dither coefficients, in the one pixel unit, the luminance corresponding to 8 bits can be expressed by only the four upper bits of the dither addition pixel data. Then, the four upper bits of the dither addition pixel data are generated as multi gradation pixel data $PD_S$.

Next, when the luminance level expressed by the average luminance signal APL is higher than a predetermined reference luminance level, the pixel-driving-data generating circuit 24 converts the 4-bit multi gradation pixel data $PD_S$ into 14-bit pixel driving data GD on the basis of the data conversion table A shown in FIG. 12 and supplies the converted data to the memory 4. Meanwhile, when the luminance level expressed by the average luminance signal APL is lower than the predetermined reference luminance level, the pixel-driving-data generating circuit 24 converts the 4-bit multi gradation pixel data $PD_S$ into 14-bit pixel driving data GD on the basis of the data conversion table B shown in FIG. 13 and supplies the converted data to the memory 4.

The drive control circuit 25 supplies the address driver 6, the first sustain driver 7, and the second sustain driver 8 with various timing signals for driving the PDP 10 as shown in FIGS. 6 and 7, similar to the drive control circuit 2 shown in FIG. 1.

However, when the average luminance level expressed by the average luminance signal APL is higher than the reference luminance level, the drive control circuit 25 reduces the number of times of application of the sustain pulse IP as the average luminance level becomes higher. The number of times of application of the sustain pulse IP is allocated to each of the sustain periods Ic of the subfields SF1 to SF14.

In particular, when the average luminance level expressed by the average luminance signal APL is higher than the reference luminance level, as the average luminance level becomes higher, the drive control circuit 25 reduces the number of times of application of the sustain pulse IP while maintaining a ratio of frequencies.

SF1: 1
SF2: 3
SF3: 5
SF4: 8
SF5: 10
SF6: 13
SF7: 16
SF8: 19
SF9: 22
SF10: 25
SF11: 28
SF12: 32
SF13: 35
SF14: 39

The number of times of application of the sustain pulse IP is allocated to each of the sustain periods Ic of the subfields SF1 to SF14. Further, when the average luminance level is smaller than the reference luminance level, the drive control circuit sets the number of times of application of the sustain pulse IP to a predetermined maximum number of times of pulse application while maintaining the ratio of the frequencies. The number of times of application of the sustain pulse IP is allocated to each of the sustain periods Ic of the subfields SF1 to SF14.

The operation when the above-mentioned driving has been performed will be described below.

First, when the average luminance level expressed by the average luminance signal APL is higher than a predetermined reference luminance level, driving is performed on the basis of the pixel driving data GD shown in FIG. 12. In the driving shown in FIG. 12, the display cell is driven to generate the first selective erase discharge in one subfield (shown by a black circle) according to a luminance grayscale level to be displayed. At this time, when a relatively low luminance is expressed (when the multi gradation pixel data $PD_S$ is in a range of [0000] to [0110]), the display cell is driven to generate the second selective erase discharge (shown by a triangle) in the address period Wc of the subfield SF10 as shown in FIG. 12. Meanwhile, when an intermediate luminance is expressed (when the multi gradation pixel data $PD_S$ is in a range of [0111] to [1011]), the display cell is driven to generate the second selective erase discharge (shown by a triangle) in the address period Wc of a subfield which is two subfields after the subfield in which the first selective erase discharge (shown by a black circle) is generated.

When the average luminance level expressed by the average luminance signal APL is lower than the predetermined reference luminance level, driving is performed on the basis of the pixel driving data GD shown in FIG. 13. In the driving shown in FIG. 13, the display cell is driven to generate the first selective erase discharge in one subfield (shown by a black circle) according to a luminance grayscale level to be displayed. At this time, when a relatively low luminance is expressed (when the multi gradation pixel data $PD_S$ is in a range of [0000] to [0110]), the display cell is driven to generate the second selective erase discharge (shown by a triangle) in the address period Wc of the subfield SF9 as shown in FIG. 13. Meanwhile, when an intermediate luminance is expressed (when the multi gradation pixel data $PD_S$ is in a range of [0111] to [1011]), the display cell is driven to generate the second selective erase discharge (shown by a triangle) in the address period Wc of a subfield which is two subfields after the subfield in which the first selective erase discharge (shown by a black circle) is generated.

In other words, in a case of performing the selective erase discharge two times during the unit display period, the display cell is driven to generate the second selective erase discharge (shown by a black triangle) in the subfield (SF9 or SF10) in which the display cell particularly suffer much interference of the electric field from the adjacent cell.

First, in a case of performing the driving shown in FIG. 12, a probability that the display cell suffers interference of the electric field from the adjacent display cells increases from the subfield SF10 in the array of the subfields SF1 to SF14. In other words, when the display cell is driven to generate the first selective erase discharge (shown by a black circle) in the subfield SF10, the display cell particularly suffers much interference of the electric field from the adjacent display cells. For this reason, when a relative low luminance is expressed (when the multi gradation data $PD_S$ is in the range of [0000] to [0110]), the display cell is always driven to generate the second selective erase discharge in the subfield SF10 as shown by black triangles in FIG. 12.

As a result, as shown in FIG. 14, even though the display cells $C_{R1}$ and $C_{B1}$ adjacent to the display cell $C_{G1}$ generate the first selective erase discharges in the subfields SF6 and SF7, respectively, both the display cells $C_{R1}$ and $C_{B1}$ generate the second selective erase discharges (shown by triangles) in the subfield SF10. Therefore, when the display cell $C_{G1}$ is driven to generate the first selective erase discharge (shown by a black circle) in the subfield SF10, the high-voltage pixel data pulse is applied to each of the adjacent display cells $C_{R1}$ and $C_{B1}$ so as to generate the second selective erase discharge. For this reason, in the subfield S10, the display cell $C_{G1}$ does not suffer interference of an electric field from the adjacent display cells $C_{R1}$ and $C_{B1}$ so as to correctly generate the first selective erase discharge.

Next, in a case of performing the driving shown in FIG. 13, since the number of times of application-of the sustain pulse IP which is allocated to each of the subfields SF1 to SF14 increases as compared to the case of performing the driving shown in FIG. 12, the probability that the display cell suffers interference of the electric field from the adjacent display cells increases from the subfield SF9 before the subfield SF10. For this reason, when a relative low luminance is expressed (when the multi gradation data $PD_S$ is in the range of [0000] to [0110]), the display cell is always driven to generate the second selective erase discharge in the subfield SF9 as shown by black triangles in FIG. 13.

As a result, as shown in FIG. 15, even though the display cells $C_{R1}$ and $C_{B1}$ adjacent to the display cell $C_{G1}$ generate the first selective erase discharges in the subfields SF5 and SF6, respectively, both the display cells $C_{R1}$ and $C_{B1}$ generate the second selective erase discharges (shown by triangles) in the subfield SF9. Therefore, when the display cell $C_{G1}$ is driven to generate the first selective erase discharge (shown by a black circle) in the subfield SF9, the high-voltage pixel data pulse is applied to each of the adjacent display cells $C_{R1}$ and $C_{B1}$ so as to generate the second selective erase discharge. For this reason, in the subfield S9, the display cell $C_{G1}$ does not suffer interference of an electric field from the adjacent display cells $C_{R1}$ and $C_{B1}$ so as to correctly generate the first selective erase discharge.

In the above-mentioned embodiment, the operation in the case of driving the plasma display panel as a display device has been described. However, the invention can be applied to drive an organic (or inorganic) electroluminescent display panel and a liquid crystal display panel.

This application claims Japanese Patent Application No. 2005-057297, which application is incorporated herein by reference.

What is claimed is:

1. A method of driving a display panel to perform grayscale display in a plurality of subfields for each unit display period, the display panel having a plurality of pixels arranged in a matrix, each pixel including a plurality of display cells emitting different color light, the method comprising:

initializing all the display cells in a lighting mode in a first subfield of the unit display period, and performing a first selective erase operation, a second selective erase operation, and a sustain operation in the unit display period, the first selective erase operation changing the display cells from the lighting mode to a blackout mode in one subfield according to a luminance level expressed by an input video signal, the second selective erase operation changing display states of the display cells from the lighting mode to the blackout mode again in at least one of subfields subsequent to the one subfield, the sustain operation making only the display cells being in the lighting mode emit light by the number of times corresponding to the luminance weight of the subfield, wherein in the unit display period, in one display cell of the pixel, when said luminance level is lower than a predetermined value, said second selective erase operation is performed in all of subfields from a subfield immediately after said one subfield to a last subfield, and in another display cell emitting light of a different color from that of the one display cell, when said luminance level is lower than said predetermined value, said second selective erase operation is performed only in a part of the subfields from a subfield immediately after said one subfield to said last subfield.

2. The method of driving a display panel according to claim 1, wherein the display cells in the pixel are disposed to be adjacent to one another on the same display line, and said one display cell is a display cell for a color with a relatively low luminance level and said another display cell emitting light of a different color from that of said one display cell is a display cell for a color with a high luminance level.

3. The method of driving a display panel according to claim 2, wherein the display cells in the pixel are a red display cell for red light emission, a green display cell for green light emission, and a blue display cell for blue light emission, and the display cell for a color with a relatively low luminance level is the blue display cell, and the display cell for a color with a high luminance level is at least one of the red display cell and the green display cell.

4. The method of driving a display panel according to claim 1, wherein the display cells maintain the lighting mode in each of subfields arranged between the first subfield and the one subfield.

* * * * *